US011545101B2

(12) United States Patent
Tomizawa et al.

(10) Patent No.: US 11,545,101 B2
(45) Date of Patent: Jan. 3, 2023

(54) DISPLAY DEVICE

(71) Applicant: Japan Display Inc., Tokyo (JP)

(72) Inventors: Kazunari Tomizawa, Tokyo (JP); Kazuhiko Sako, Tokyo (JP); Junji Kobashi, Tokyo (JP); Tomoyuki Ishihara, Tokyo (JP)

(73) Assignee: Japan Display Inc., Tokyo (JP)

( * ) Notice: Subject to any disclaimer, the term of this patent is extended or adjusted under 35 U.S.C. 154(b) by 0 days.

(21) Appl. No.: 17/828,644

(22) Filed: May 31, 2022

(65) Prior Publication Data

US 2022/0392418 A1 Dec. 8, 2022

(30) Foreign Application Priority Data

Jun. 3, 2021 (JP) ..... JP2021-093662

(51) Int. Cl.
*G09G 3/36* (2006.01)
*G09G 3/34* (2006.01)

(52) U.S. Cl.
CPC ..... *G09G 3/3611* (2013.01); *G09G 3/3406* (2013.01); *G09G 2300/023* (2013.01); *G09G 2300/0452* (2013.01); *G09G 2320/0626* (2013.01)

(58) Field of Classification Search
CPC ..... G09G 3/3406; G09G 3/3611; G09G 2300/023; G09G 2300/0452; G09G 2320/0626
See application file for complete search history.

(56) References Cited

U.S. PATENT DOCUMENTS

| | | | | |
|---|---|---|---|---|
| 11,217,188 | B2 * | 1/2022 | Guo | G09G 3/3607 |
| 11,289,037 | B2 * | 3/2022 | Kimura | G02F 1/1347 |
| 11,348,545 | B2 * | 5/2022 | Kimura | G09G 3/3607 |
| 2021/0027728 | A1 * | 1/2021 | Kimura | G02F 1/13471 |
| 2021/0142745 | A1 | 5/2021 | Kimura et al. | |

FOREIGN PATENT DOCUMENTS

WO WO2019225137 A1 11/2019

* cited by examiner

*Primary Examiner* — Gene W Lee
(74) *Attorney, Agent, or Firm* — K&L Gates LLP

(57) ABSTRACT

According to an aspect, a display device includes: a first liquid crystal panel; a second liquid crystal panel; a light source configured to emit light; and a controller configured to control the first liquid crystal panel and the second liquid crystal panel based on an image signal corresponding to a resolution of the second liquid crystal panel. The first liquid crystal panel includes dimming pixels, and the second liquid crystal panel includes pixels. More than one of the pixels is arranged within a region of each of the dimming pixels. The controller performs blurring processing and determination of dimming gradation values as processing related to operation of the second liquid crystal panel. Each of the dimming gradation values corresponds to a highest gradation value set after the blurring processing among gradation values set for the more than one pixel arranged within the region of each of the dimming pixels.

6 Claims, 25 Drawing Sheets

| PHENOMENON | PANEL SCHEMATIC VIEW | EXAMPLE OF VIEW FROM OBLIQUE VIEWPOINT |
|---|---|---|
| DOUBLE IMAGE |   |  |
| IMAGE CHIPPING |   |  |

DISPLAY DEVICE

CROSS-REFERENCE TO RELATED APPLICATION

This application claims the benefit of priority from Japanese Patent Application No. 2021-093662 filed on Jun. 3, 2021, the entire contents of which are incorporated herein by reference.

BACKGROUND

1. Technical Field

What is disclosed herein relates to a display device.

2. Description of the Related Art

A configuration is known in which a dimming panel is provided between a liquid crystal display panel and a light source to further increase contrast of an image (refer to, for example, International Publication No. WO2019/225137).

An image can be viewed from an oblique viewpoint by setting a region where the dimming panel transmits light to be larger than a region of pixels controlled to transmit light in the liquid crystal display panel. On the other hand, when a region as the smallest unit of a dimming region in the dimming panel includes the pixels provided in the liquid crystal display panel, it may be difficult to cause the region where the dimming panel transmits light to correspond to the image to be output by the liquid crystal display panel, depending on control routines of the dimming panel.

For the foregoing reasons, there is a need for a display device capable of controlling light so as to provide light corresponding to an image to be output more preferably.

SUMMARY

According to an aspect, a display device includes: a first liquid crystal panel; a second liquid crystal panel arranged on one surface side of the first liquid crystal panel so as to face the first liquid crystal panel; a light source configured to emit light from the other surface side of the first liquid crystal panel; and a controller configured to control the first liquid crystal panel and the second liquid crystal panel based on an image signal corresponding to a resolution of the second liquid crystal panel. The first liquid crystal panel includes a plurality of dimming pixels, the second liquid crystal panel includes a plurality of pixels, and more than one of the pixels is arranged within a region of each of the dimming pixels. The controller performs blurring processing and determination of dimming gradation values as processing related to operation of the second liquid crystal panel.

In the blurring processing, based on gradation values indicated by a pixel signal contained in the image signal, lower gradation values are set for second pixels farther from a first pixel that is included in the pixels and given the pixel signal, the second pixels being included in the pixels and arranged within a predetermined region around the first pixel. Each of the dimming gradation values corresponds to a highest gradation value set after the blurring processing among gradation values set for the more than one pixel arranged within the region of each of the dimming pixels. A degree of light transmission through the dimming pixel is controlled in accordance with the dimming gradation value.

DETAILED DESCRIPTION

Figure 1:
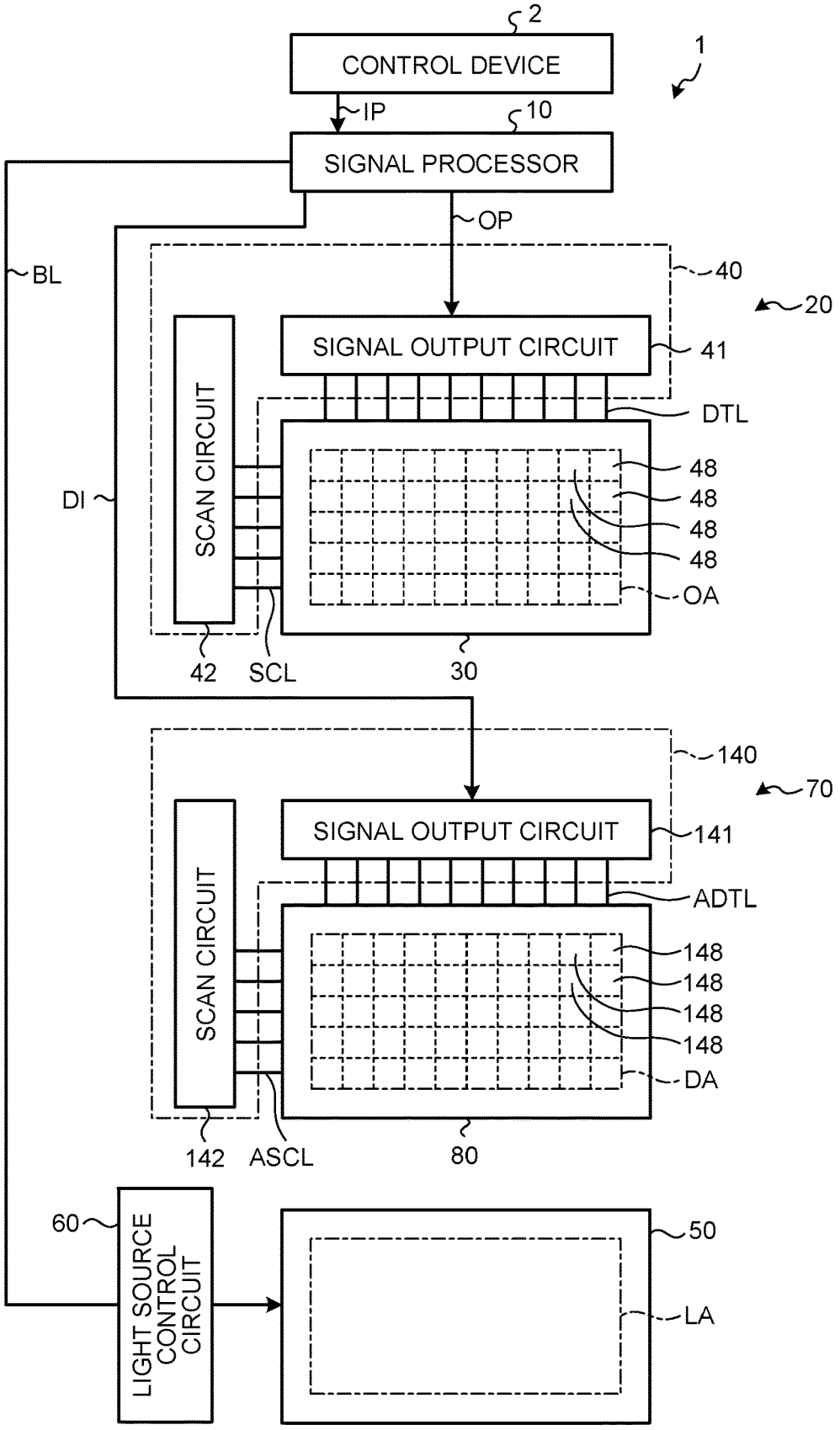
FIG. 1 is a view illustrating an example of a main configuration of a display device according to a first embodiment.

Hereinafter, embodiments of the present disclosure will be described with reference to the drawings. What is disclosed herein is merely an example, and it is needless to say that appropriate modifications within the gist of the invention at which those skilled in the art can easily arrive are encompassed in the scope of the present disclosure. In the drawings, widths, thicknesses, shapes, and the like of the components can be schematically illustrated in comparison with actual modes for clearer explanation. They are, however, merely examples and do not limit interpretation of the present disclosure. In the present specification and the drawings, the same reference numerals denote components similar to those described before with reference to the drawing that has already been referred to, and detail explanation thereof can be appropriately omitted.

In this disclosure, when an element is described as being "on" another element, the element can be directly on the other element, or there can be one or more elements between the element and the other element.

First Embodiment

FIG. 1 is a view illustrating an example of a main configuration of a display device 1 according to a first embodiment. The display device 1 in the first embodiment includes a signal processor 10, a display part 20, a light source device 50, a light source control circuit 60, and a dimmer (light dimming part) 70. The signal processor 10 performs various types of output based on an input signal IP received from an external control device 2 and controls operations of the display part 20, the light source device 50, and the dimmer 70. The input signal IP functions as data for causing the display device 1 to display and output an image and is, for example, a red-green-blue (RGB) image signal. The input signal IP corresponds to the resolution of a display panel 30. That is to say, the input signal IP includes pixel signals corresponding to the number of pixels 48 of the display panel 30, which will be described later, and an arrangement thereof in the X direction and the Y direction. The signal processor 10 outputs, to the display part 20, an output image signal OP generated based on the input signal IP. The signal processor 10 outputs, to the dimmer 70, a dimming signal DI generated based on the input signal IP. When the input signal IP is input, the signal processor 10 outputs, to the light source control circuit 60, a light source drive signal BL for controlling lighting of the light source device 50. The light source control circuit 60 is, for example, a driver circuit for the light source device 50 and operates the light source device 50 in accordance with the light source drive signal BL. The light source device 50 includes a light source configured to emit light from a light emitting area LA. In the first embodiment, the light source control circuit 60 operates the light source device 50 such that a certain amount of light is emitted from the light emitting area LA of the light source device 50 in accordance with a display timing of a frame image.

The display part 20 includes the display panel 30 and a display panel driver 40. The display panel 30 has a display area OA in which the pixels 48 are provided. The pixels 48 are arranged in a matrix with a row-column configuration, for example. The display panel 30 in the first embodiment is a liquid crystal image display panel. The display panel driver 40 includes a signal output circuit 41 and a scan circuit 42. The signal output circuit 41 functions as what is called a source driver and drives the pixels 48 in accordance with the output image signal OP. The scan circuit 42 functions as what is called a gate driver and outputs a drive signal for scanning the pixels 48 arranged in a matrix with a row-column configuration in units of a predetermined number of rows (for example, in units of one row). The pixels 48 are driven to perform output of gradation values in accordance with the output image signal OP at timing when the drive signal is output.

The dimmer 70 adjusts the amount of light that is emitted from the light source device 50 and is output through the display area OA. The dimmer 70 includes a dimming panel 80 and a dimming panel driver 140. The dimming panel 80 has a dimming area DA where the transmittance of light can be changed. The dimming area DA is arranged at a position overlapping the display area OA in a planar viewpoint. The dimming area DA covers the entire display area OA in the planar viewpoint. The light emitting area LA covers the entire display area OA and the entire dimming area DA in the planar viewpoint. The planar viewpoint is a viewpoint when an X-Y plane is viewed from the front side.

Figure 2:
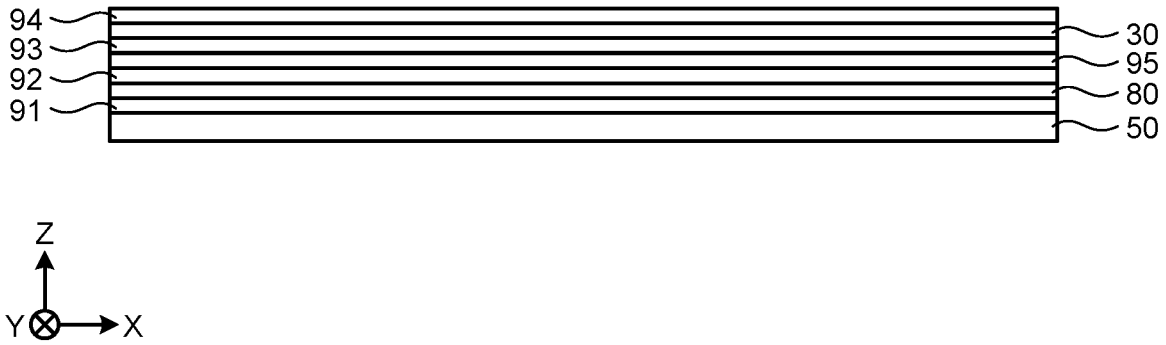
FIG. 2 is a view illustrating a positional relation between a display panel, a dimming panel, and a light source device.

FIG. 2 is a view illustrating a positional relation between the display panel 30, the dimming panel 80, and the light source device 50. In the first embodiment, the display panel 30, the dimming panel 80, and the light source device 50 are stacked as illustrated in FIG. 2. Specifically, the dimming panel 80 is stacked on a light emitting surface side where light is emitted from the light source device 50. The display panel 30 is stacked on a side opposite to the light source device 50 with the dimming panel 80 interposed therebetween. Light emitted from the light source device 50 illuminates the display panel 30 after the light amount thereof is adjusted in the dimming area DA of the dimming panel 80. The display panel 30 is illuminated from the rear surface side where the light source device 50 is located and displays and outputs an image on a side (display surface side) opposite to the rear surface side. The light source device 50 thus functions as a backlight that illuminates the display area OA of the display panel 30 from the rear surface side. In the first embodiment, the dimming panel 80 is provided between the display panel 30 and the light source device 50. Hereinafter, a direction in which the display panel 30, the dimming panel 80, and the light source device 50 are stacked is referred to as a Z direction. Two directions orthogonal to the Z direction are the X direction and the Y direction. The X direction and the Y direction are orthogonal to each other. The pixels 48 are arrayed in a matrix with a row-column configuration along the X direction and the Y direction. Specifically, the number of pixels 48 aligned in the X direction is h, and the number of pixels 48 aligned in the Y direction is v. h and v are natural numbers of equal to or more than 2.

A first polarizer (POL) 91 is provided on the rear surface side of the dimming panel 80. A second POL 92 is provided on the display surface side of the dimming panel 80. A third POL 93 is provided on the rear surface side of the display panel 30. A fourth POL 94 is provided on the display surface side of the display panel 30. A diffusion layer 95 is provided between the second POL 92 and the third POL 93. Each of the first POL 91, the second POL 92, the third POL 93, and the fourth POL 94 transmits polarized light in a specific direction and does not transmit polarized light in other directions. The polarization direction of polarized light that the first POL 91 transmits is orthogonal to the polarization direction of polarized light that the second POL 92 transmits. The polarization direction of polarized light that the second POL 92 transmits is the same as the polarization direction of polarized light that the third POL 93 transmits. The polarization direction of polarized light that the third POL 93 transmits is orthogonal to the polarization direction of polarized light that the fourth POL 94 transmits. The diffusion layer 95 diffuses and outputs incident light. Since the polarization directions of polarized light of the second POL 92 and the third POL 93 are the same, either of them may be omitted. With this configuration, improvement in the transmittance is expected. When both of the second POL 92 and the third POL 93 are provided, contrast can be improved in comparison with the case where one of them is provided. When either of the second POL 92 or the third POL 93 is omitted, it is desired that the second POL 92 be omitted. This is because the third POL 93 limits the polarization direction of light diffused by the diffusion layer 95 and therefore an effect of improvement in the contrast can be expected.

Figure 3:
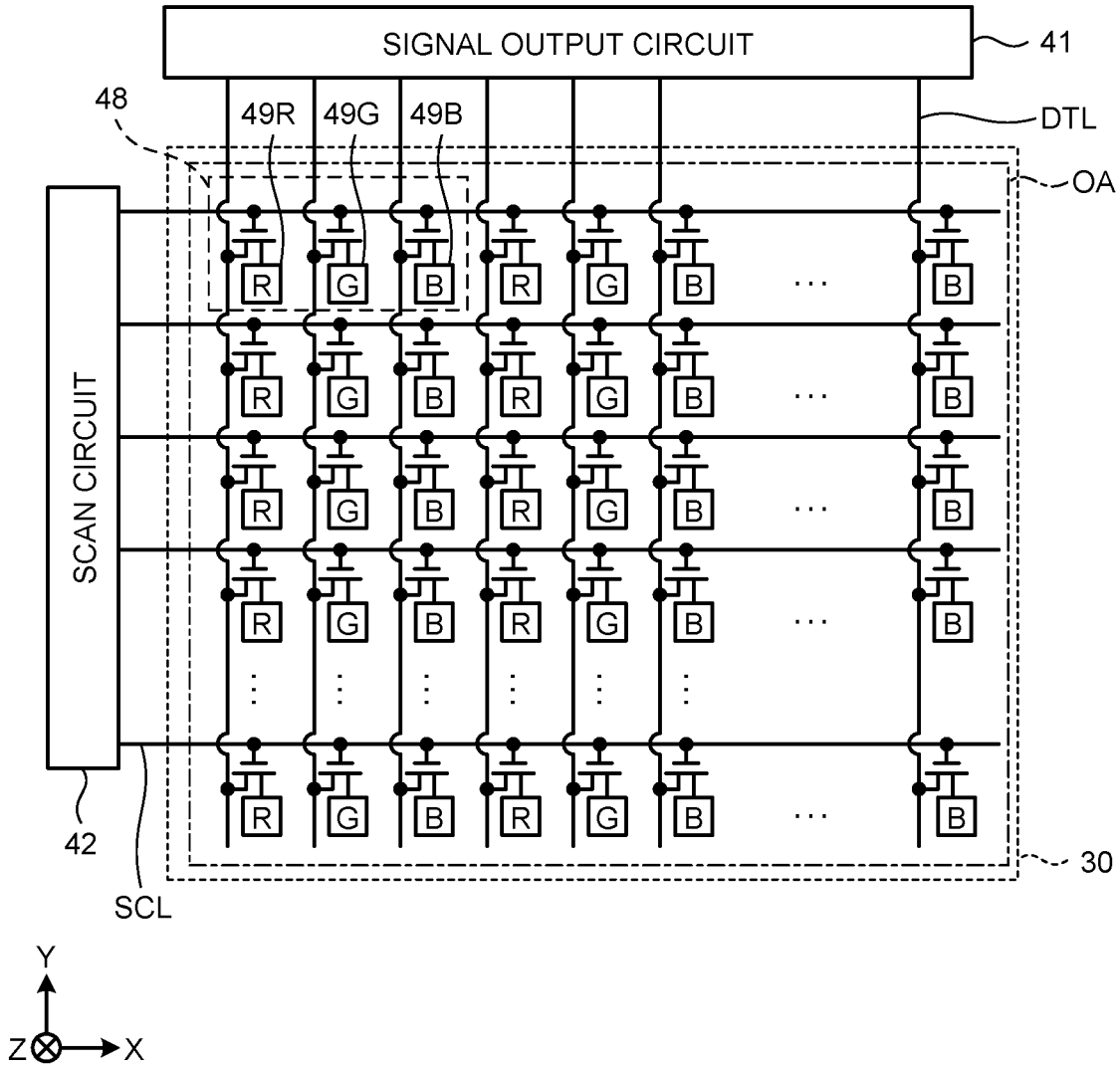
FIG. 3 is a view illustrating an example of a pixel array of the display panel.

FIG. 3 is a view illustrating an example of a pixel array of the display panel 30. As illustrated in FIG. 3, each of the pixels 48 includes, for example, a first sub pixel 49R, a second sub pixel 49G, and a third sub pixel 49B. The first sub pixel 49R displays a first primary color (for example, red). The second sub pixel 49G displays a second primary color (for example, green). The third sub pixel 49B displays a third primary color (for example, blue). Each of the pixels 48 arrayed in a matrix with a row-column configuration on the display panel 30 thus includes the first sub pixel 49R that displays a first color, the second sub pixel 49G that displays a second color, and the third sub pixel 49B that displays a third color. The first color, the second color, and the third color are not limited to the first primary color, the second primary color, and the third primary color, and it is sufficient that they are different from one another, such as complementary colors. In the following explanation, when the first sub pixel 49R, the second sub pixel 49G, and the third sub pixel 49B need not to be distinguished from one another, they are referred to as sub pixels 49.

In addition to the first sub pixel 49R, the second sub pixel 49G, and the third sub pixel 49B, each of the pixels 48 may include an additional sub pixel 49. For example, each of the pixels 48 may include a fourth sub pixel that displays a fourth color. The fourth sub pixel displays the fourth color (for example, white). The fourth sub pixel is preferably brighter than the first sub pixel 49R that displays the first color, the second sub pixel 49G that displays the second color, and the third sub pixel 49B that displays the third color when they are irradiated with the same lighting amount of the light source.

The display device 1 is, more specifically, a transmissive color liquid crystal display device. As illustrated in FIG. 3, the display panel 30 is a color liquid crystal display panel, and first color filters that transmit light in the first primary color are arranged between the first sub pixels 49R and an image observer, second color filters that transmit light in the second primary color are arranged between the second sub pixels 49G and the image observer, and third color filters that transmit light in the third primary color are arranged between the third sub pixels 49B and the image observer. The first color filters, the second color filters, and the third color filters are components included in a filter film 26, which will be described later.

When the fourth sub pixels are provided, no color filter is arranged between the fourth sub pixels and the image observer. In this case, large level differences in height are generated in the fourth sub pixels. For this reason, the fourth sub pixels may be provided with transparent resin layers instead of the color filters. The resin layers can restrain the level differences in height from being generated in the fourth sub pixels.

The signal output circuit 41 is electrically coupled to the display panel 30 through signal lines DTL. The display panel driver 40 uses the scan circuit 42 to select the sub pixels 49 in the display panel 30 and to control ON and OFF of switching elements (for example, thin film transistors (TFTs)) for controlling the operations (light transmittances) of the sub pixels 49. The scan circuit 42 is electrically coupled to the display panel 30 through scan lines SCL.

In the first embodiment, the signal lines DTL are aligned in the X direction. Each signal line DTL extends in the Y direction. The scan lines SCL are aligned in the Y direction. Each scan line SCL extends in the X direction. Thus, in the first embodiment, the pixels 48 are driven in units of a pixel row (line) containing the pixels 48 that are aligned in the X direction so as to share one of the scan lines SCL in accordance with the drive signal output from the scan circuit 42. Hereinafter, a simple expression "line" refers to a pixel row containing the pixels 48 aligned in the X direction so as to share the scan line SCL.

The direction along the extension direction of each scan line SCL is referred to as a horizontal scan direction. The alignment direction of the scan lines SCL is referred to as a vertical scan direction. In the first embodiment, the X direction corresponds to the horizontal scan direction, and the Y direction corresponds to the vertical scan direction.

Figure 4:
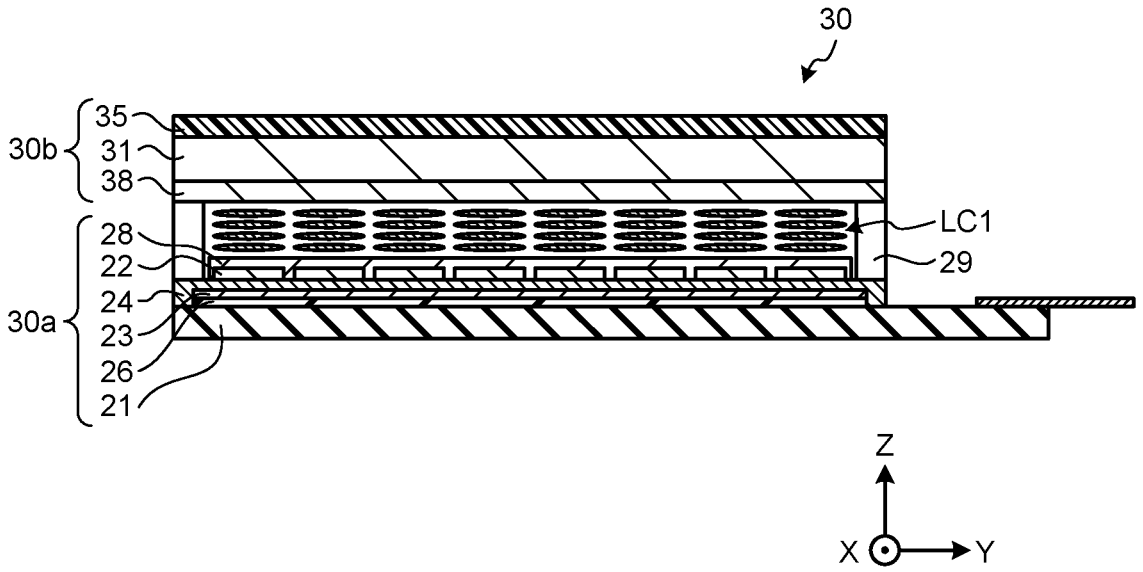
FIG. 4 is a cross-sectional view illustrating an example of a schematic cross-sectional structure of the display panel.

FIG. 4 is a cross-sectional view illustrating an example of a schematic cross-sectional structure of the display panel 30. An array substrate 30*a* includes the filter film 26 provided on the upper side of a pixel substrate 21 such as a glass substrate, a counter electrode 23 provided on the upper side of the filter film 26, an insulating film 24 provided on the upper side of the counter electrode 23 so as to be in contact with the counter electrode 23, pixel electrodes 22 on the upper side of the insulating film 24, and a first orientation film 28 provided on the uppermost surface side in the array substrate 30*a*. A counter substrate 30*b* includes a counter pixel substrate 31 such as a glass substrate, a second orientation film 38 provided on the bottom surface of the counter pixel substrate 31, and a polarizing plate 35 provided on the upper surface thereof. The array substrate 30*a* and the counter substrate 30*b* are fixed to each other with a seal portion 29 therebetween. A liquid crystal layer LC1 is sealed in a space enclosed by the array substrate 30*a*, the counter substrate 30*b*, and the seal portion 29. The liquid crystal layer LC1 contains liquid crystal molecules the orientation directions of which are changed in accordance with an applied electric field. The liquid crystal layer LC1 modulates light that passes through the inside of the liquid crystal layer LC1 in accordance with an electric field state. The orientation directions of the liquid crystal molecules in the liquid crystal layer LC1 are changed by the electric field applied between the pixel electrodes 22 and the counter electrode 23, and the transmission amount of light passing through the display panel 30 changes. Each of the sub pixels 49 has the pixel electrode 22. The switching elements for individually controlling the operations (light transmittances) of the sub pixels 49 are electrically coupled to the pixel electrodes 22.

The dimmer 70 includes the dimming panel 80 and the dimming panel driver 140. The dimming panel 80 in the first embodiment has a similar configuration to that of the display panel 30 illustrated in FIG. 4 except that the filter film 26 is omitted. Thus, the dimming panel 80 includes dimming pixels 148 with no color filter provided (refer to FIG. 1) unlike the pixels 48 (refer to FIG. 3) each including the first sub pixel 49R, the second sub pixel 49G, and the third sub pixel 49B distinguished from one another on the basis of the colors of the color filters.

A signal output circuit 141 and a scan circuit 142 included in the dimming panel driver 140 have similar configurations to those of the signal output circuit and the scan circuit of the display panel driver 40 except that the signal output circuit 141 and the scan circuit 142 are coupled to the dimming panel 80. Signal lines ADTL between the dimming panel 80 and the dimming panel driver 140, which are illustrated in FIG. 1, have a similar configuration to those of the signal lines DTL explained with reference to FIG. 3. Scan lines ASCL between the dimming panel 80 and the dimming panel driver 140, which are illustrated in FIG. 1, have a similar configuration to those of the scan lines SCL explained with reference to FIG. 3. A region that is controlled as one dimming unit in the dimming panel 80, however, is large enough to include more than one of the pixels 48 in the planar viewpoint. In explanation of the first embodiment, the width of the region controlled as one dimming unit in the X direction corresponds to the width of three pixels 48 aligned in the X direction. The width of the region controlled as one dimming unit in the Y direction corresponds to the width of three pixels 48 aligned in the Y direction. Nine pixels 48 of 3×3 are therefore arranged in the region controlled as one dimming unit. The number of pixels 48 in the region controlled as one dimming unit exemplified herein is only an example and is not limited thereto. The number of pixels 48 in the region controlled as one dimming unit can be appropriately changed. For example, four pixels 48 of 2×2 may be arranged in the region controlled as one dimming unit. Hereinafter, one dimming unit may be referred to as one dimming pixel 148, in some cases.

One pixel electrode 22 or more than one pixel electrode 22 may be provided in the region controlled as one dimming pixel 148 in the dimming panel 80. When more than one pixel electrode 22 is provided in the region controlled as one dimming pixel 148, the pixel electrodes 22 are controlled to have the same potential. The pixel electrodes 22 can thereby behave substantially in a similar manner to one pixel electrode 22.

In the first embodiment, the arrangement of the pixels 48 in the display area OA is the same as the arrangement of the dimming pixels 148 in the dimming area DA. In the first embodiment, the number of pixels 48 aligned in the X direction in the display area OA is therefore equal to the number of dimming pixels 148 aligned in the X direction in the dimming area DA. In the first embodiment, the number of pixels 48 aligned in the Y direction in the display area OA is equal to the number of pixels 148 aligned in the Y direction in the dimming area DA. In the first embodiment, the display area OA and the dimming area DA overlap with each other in the X-Y planar viewpoint. The Z direction corresponds to an optical axis LL of light emitted from the light emitting area LA of the light source device 50. Thus, an optical axis (optical axis LL) of light passing through one of the pixels 48 coincides with an optical axis of light passing through one dimming pixel 148 located at a position overlapping with the one pixel 48 in the X-Y planar view point. Light emitted from the light emitting area LA is, however, incoherent light that diffuses radially. Therefore, light rays in directions not along the optical axis LL may also enter the dimming pixels 148 and the pixels 48.

Light emitted from the light source device 50 enters the dimming panel 80 after passing through the first POL 91. Light that has entered the dimming panel 80 and has passed through the dimming pixels 148 enters the display panel 30 after passing through the second POL 92, the diffusion layer 95, and the third POL 93. Light that has entered the display panel 30 and has passed through the pixels 48 is output after passing through the fourth POL 94. A user of the display device 1 views an image that has been output from the display device 1 based on the light that has been output in such a manner.

As far as the case is concerned in which an image is viewed from the front side of the plate surface (X-Y plane) of the display device 1, it is considered that the user of the display device 1 can view the image output from the display device 1 with no problem, when a dimming pixel 148 capable of transmitting light having an optical axis that coincides with the optical axis LL passing through a pixel 48 controlled to transmit light for displaying the image on the display panel 30, is controlled to transmit light. Hereinafter, an optical axis of a pixel 48 denotes an optical axis of light passing through the pixel 48 when the pixel 48 is controlled to transmit light. An optical axis of a dimming pixel 148 denotes an optical axis of light passing through the dimming pixel 148 when the dimming pixel 148 is controlled to transmit light. In this case, a dimming pixel 148 corresponding to a pixel 48 controlled not to transmit light on the display panel 30 (i.e., the dimming pixel 148 an optical axis of which coincides with an optical axis of the pixel 48 controlled not to transmit light) is controlled not to transmit light. The user of the display device 1, however, does not always view the image from the front side of the plate surface (X-Y plane) of the display device 1. When the pixels 48 and the dimming pixels 148 are controlled in the same manner as the above-mentioned case where the user views the image from the front side of the plate surface (X-Y plane) of the display device 1, the user viewing the fourth POL 94 side of the display device 1 in a direction having an angle (oblique angle) intersecting with the plate surface and the Z direction may view a double image or image chipping.

Figure 5:
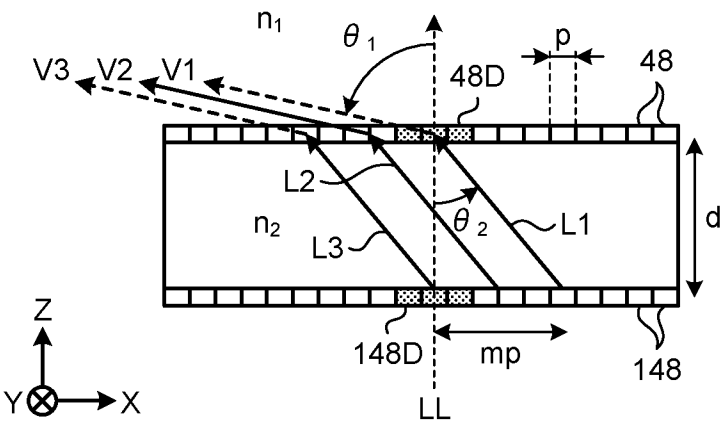
FIG. 5 is a view illustrating generation principles and examples of a double image and image chipping.
Figure 5:
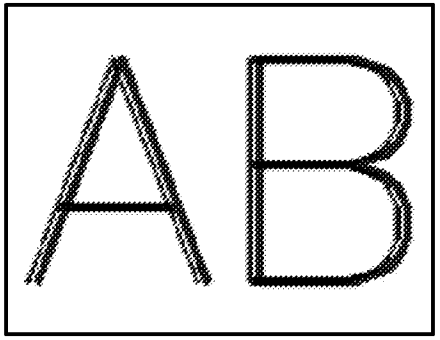
Figure 5:
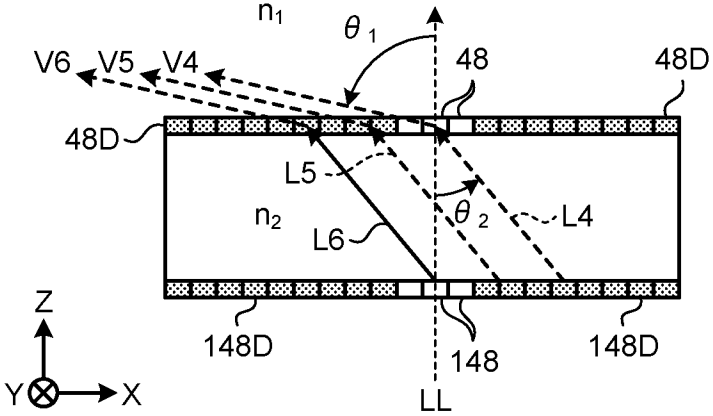
Figure 5:
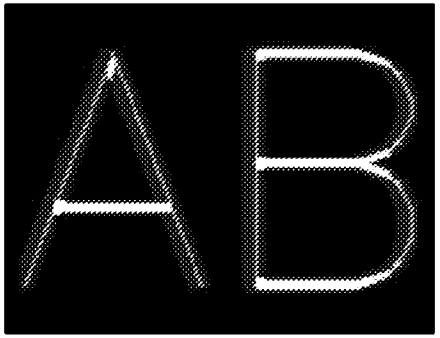

FIG. 5 is a view illustrating generation principles and examples of the double image and image chipping. FIG. 5 illustrates schematic cross-sectional views of the display device 1 in the column of "Panel Schematic View". In the schematic cross-sectional views, the pixels 48 and the dimming pixels 148 for which the orientation of the liquid crystal is controlled to transmit light, are illustrated by outlined rectangles. In the schematic cross-sectional views, sets of the pixels 48 for which the orientation of the liquid crystal is controlled not to transmit light, are illustrated by rectangles with a dot pattern as light blocking portions 48D. In the schematic cross-sectional view, sets of the dimming pixels 148 for which the orientation of the liquid crystal is controlled not to transmit light, are illustrated by rectangles with the dot pattern as light blocking portions 148D.

When light that has passed through the dimming pixels 148, through a layered structure (the second POL 92, the diffusion layer 95, and the third POL 93) between the dimming pixels 148 and the pixels 48, and then through the pixels 48, is output from an output surface side of the display panel 30 through the fourth POL 94 (refer to FIG. 2), refraction occurs due to difference in a refractive index between the layered structure and the air on the output surface side. FIG. 5 illustrates the refraction by difference between a light traveling angle $\theta_2$ inside the display device 1 and a light output angle $\theta_1$ outside the output surface of the display device 1 due to difference between a refractive index $n_2$ of the layered structure and a refractive index $n_1$ of the air.

More specifically, the equation of $n_1 \sin \theta_1 = n_2 \sin \theta_2$ is satisfied. When an interval between the pixels 48 and the dimming pixels 148 in the Z direction is d, the equation of $d \tan \theta_2 = mp$ is satisfied. p is the width of each pixel 48 in the X direction. m is a numerical value that indicates the amount of a positional discrepancy in the X direction between a light output point on the dimming pixel 148 side and a light input point on the pixel 48 side and is expressed in terms of the number of pixels 48, the positional discrepancy being caused by the light traveling angle $\theta_2$ inside the display device 1. $n_1$ is 1.0, and $n_2$ is a different value from 1.0. d is, strictly speaking, an interval between an intermediate position of the pixels 48 in the Z direction and an intermediate position of the dimming pixels 148 in the Z direction. The intermediate position of the pixels 48 in the Z direction is an intermediate position of the display panel 30 in the Z direction. The intermediate position of the dimming pixels 148 in the Z direction is an intermediate position of the dimming panel 80 in the Z direction.

As illustrated in the column of "Panel Schematic View" in the row of "Double Image", if the light blocking portion 48D does not block light, light L1 that has passed through the dimming pixels 148 is output as light V1 with the above-mentioned refraction. In practice, the light V1 is not output because the light blocking portion 48D blocks light. Light L2 that has passed through the dimming pixels 148 is output as light V2. If the light blocking portion 148D does not block light, light traveling along a light travel axis L3 is output as light V3 indicated by a dashed line.

When the output surface of the display device 1 in the state illustrated in the column of "Panel Schematic View" in the row "Double Image" is viewed from the front side, both sides with the light blocking portion 48D interposed therebetween in the X direction should be lit. That is to say, there is one non-light emitting (black) area viewed from the front viewpoint. On the other hand, when the output surface of the display device 1 is viewed from a direction at an oblique angle that forms the output angle $\theta_1$ with respect to the X-Y plane and the X direction, optical axes of light L1 and L3 that are not generated in practice are present with the light V2 interposed therebetween. That is to say, two non-light emitting (black) areas aligned in the X direction with the light V2 interposed therebetween are generated. As described above, an image that is formed by one non-light emitting (black) area when viewed from the front viewpoint may be viewed as a double image that is formed by two non-light emitting (black) areas at the oblique angle. In FIG. 5, an example of the generation of such a double image is illustrated in the column of "Example Of View From Oblique Viewpoint" in the row of "Double Image".

As illustrated in the column of "Panel Schematic View" in the row of "Image Chipping", if the light blocking portions 148D do not block light, light L4 is output as light V4. In practice, the light V4 is not output because the light blocking portion 148D blocks light. If the light blocking portions 148D do not block light, light L5 is output as light V5. In practice, the light V5 is not output because the light blocking portion 148D blocks light. Even if the light blocking portions 148D do not block light, the light V5 is not output because the light blocking portions 48D block light. If the light blocking portions 48D do not block light, light L6 that has passed through the dimming pixels 148 is output as light V6. In practice, the light V6 is not output because the light blocking portion 48D blocks light.

In the state illustrated in the column of "Panel Schematic View" in the row of "Image Chipping", the light blocking portions 48D are generated so as to sandwich in the X direction the pixels 48 that can transmit light. Therefore, one light emitting area interposed between non-light emitting (black) areas should be viewed from the front viewpoint. On the other hand, when the output surface of the display device 1 is viewed from the direction at the oblique angle that forms the output angle $\theta_1$ with respect to the X-Y plane and the X direction, the light emitting area is not viewed. This is because none of the light V4, V5, and V6 is output as described above. An image that is formed by one light emitting area when viewed from the front viewpoint may be invisible at the oblique angle as described above. The above-mentioned mechanism causes the image chipping when the display device 1 is viewed from the direction at the oblique angle. In FIG. 5, an example of the generation of such image chipping is illustrated in the column of "Example Of View From Oblique Viewpoint" in the row of "Image Chipping". Although each of the dimming pixels 148 schematically illustrated in FIG. 5 has the same width in the X direction as that of each of the pixels 48 for the purpose of facilitating understanding of a correspondence relation of their positions with the pixels 48, more than one pixel 48 is included within the region of one dimming pixel 148 in practice, as described above.

In the first embodiment, blurring processing is applied in control of the region in which the dimming panel 80 transmits light. The blurring processing is processing of controlling the dimming pixels 148 such that the dimming panel 80 causes light to pass through a wider region than a light transmission region that would be generated when the input signal IP is faithfully reflected. As a result, in the dimming panel 80 to which the blurring processing is applied, a region allowing light to pass therethrough is wider than a region in the display panel 30 allowing light to pass therethrough. The following describes blurring processing with reference to FIG. 6.

Figure 6:
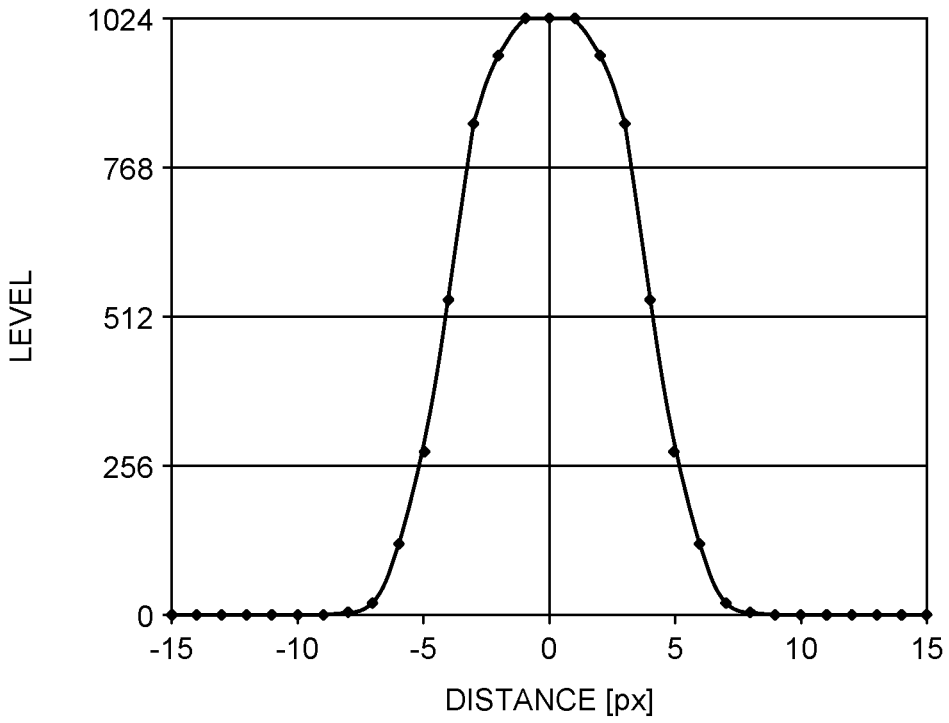
FIG. 6 is a graph illustrating an example of a relation between a distance from a dimming pixel transmitting light having an optical axis that coincides with an optical axis of light passing through a pixel that is controlled to transmit light at the highest gradation and the degree (level) of light transmission that is controlled by blurring processing.

FIG. 6 is a graph illustrating an example of a relation between a distance from the dimming pixel 148 transmitting light having an optical axis that coincides with the optical axis LL of light passing through the pixel 48 that is controlled to transmit light at the highest gradation and the degree (level) of light transmission that is controlled by the blurring processing. In the graph in FIG. 6, the horizontal axis indicates the distance, and the vertical axis indicates the degree of light transmission. It is assumed that, as for the distance, a dimming pixel 148 transmitting light having the optical axis LL that coincides with the optical axis of light passing through a pixel 48 that is controlled to transmit light at the highest gradation, is located at a position corresponding to a distance of "0". It is also assumed that a dimming pixel 148 adjacent to the dimming pixel 148 at the distance of "0" is located at a distance of "1" relative to the dimming pixel 148 at the distance of "0". It is also assumed that the other dimming pixels 148 are each arranged in the X direction or the Y direction at a distance of the number of intervening dimming pixels 148+1 with reference to the dimming pixel 148 at the distance of "0". FIG. 6 illustrates an example where the gradation as the degree of light transmission is a value of 10 bits (1024 gradations). The gradation is, however, only an example, is not limited thereto, and can be appropriately changed.

As illustrated in FIG. 6, in the first embodiment, the blurring processing controls not only the dimming pixel 148 at the distance of "0" transmitting light having the optical axis LL that coincides with the optical axis of light passing through the pixel 48 that is controlled to transmit light but also the dimming pixels 148 at distances in a range of 1 to 6 to transmit light. The dimming pixels 148 at the distance of "1" are controlled to transmit light at a degree equivalent to that of the dimming pixel 148 at the distance of "0". The dimming pixels 148 at the distances of equal to or greater than "2" are controlled such that the degree of their light transmission is lowered as the distance increases.

Specific setting of a distance from the dimming pixel 148 at the distance of "0" to a region through which light is passed by the blurring processing is arbitrarily determined. More specifically, the region with respect to the dimming pixel 148 at the distance of "0" to which the blurring processing is applied is set on the basis of various factors such as an allowable angle range for the angle ($\theta_1$) at which the oblique viewpoint to the display device 1 is established and the magnitude of the above-mentioned interval d. The same concept is used to set a region (predetermined region) as the target of the blurring processing with a certain pixel 48 as a center that is performed in processing based on the gradation values of the pixels 48 by a blurring processor 12, which will be described later.

Figure 7:
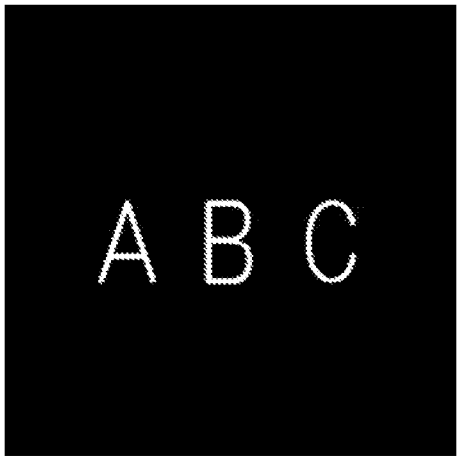
FIG. 7 is a view illustrating an example of display output based on an input signal for the display device.
Figure 8:
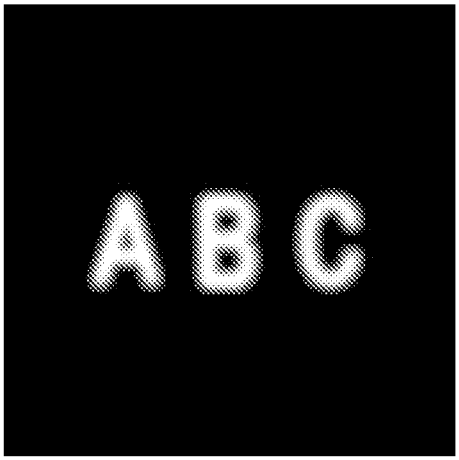
FIG. 8 is a view illustrating a light transmission region by the dimming panel to which the blurring processing is applied based on the display output illustrated in FIG. 7.

FIG. 7 is a view illustrating an example of display output based on the input signal IP for the display device 1. FIG. 8 is a view illustrating a light transmission region by the dimming panel 80 to which the blurring processing is applied on the basis of the display output illustrated in FIG. 7. In FIG. 7 and FIG. 8, a region where light is controlled to pass through is indicated in white whereas a region where light is controlled not to pass through is indicated in black. As illustrated by comparison between FIG. 7 and FIG. 8, the dimming pixels 148 of the dimming panel 80 to which the blurring processing is applied are controlled to allow light to pass through a wider region compared to the display output. Specifically, the degree of light transmission through the dimming pixels 148 is controlled such that the light transmission region is expanded outward by making borders of the light transmission region in the display output illustrated in FIG. 7 bolder.

Hereinafter, the blurring processing applied in the first embodiment is explained more in detail with reference to FIG. 9, FIG. 10, and FIG. 11.

Figure 9:
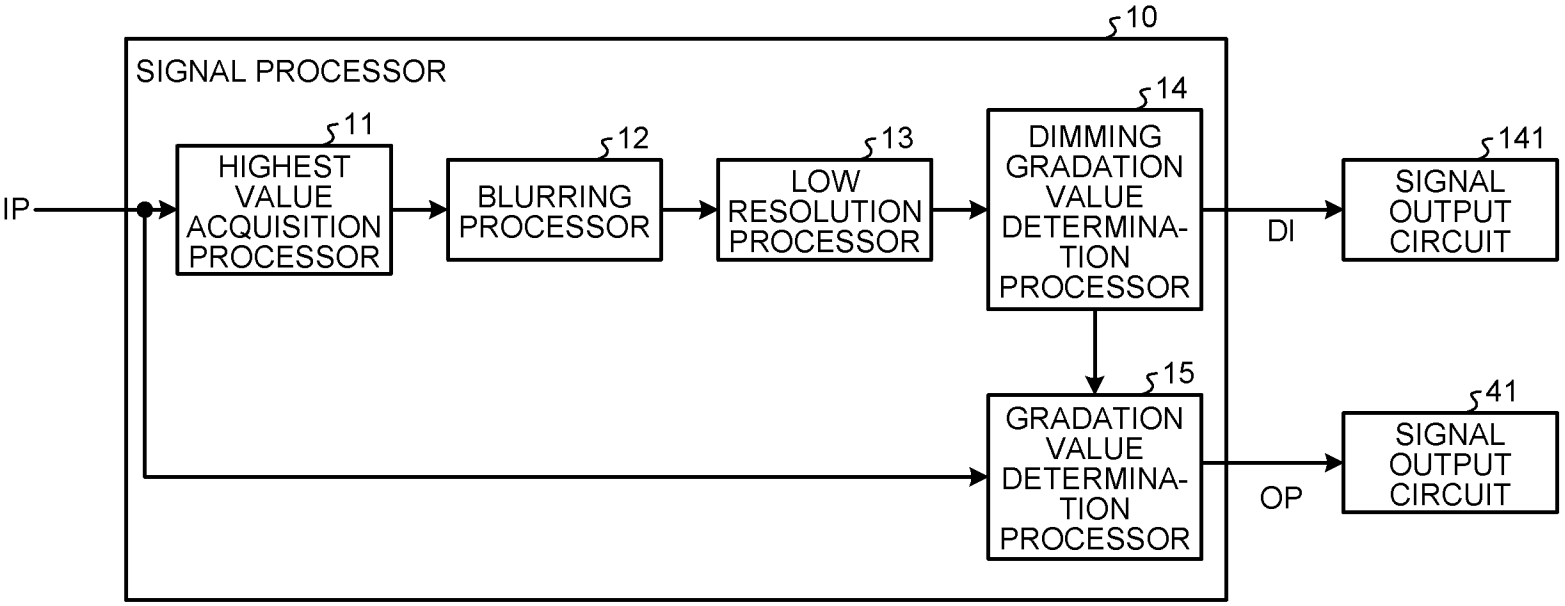
FIG. 9 is a block diagram illustrating the functional configuration of a signal processor and input and output of the signal processor.

FIG. 9 is a block diagram illustrating the functional configuration of the signal processor 10 and input and output of the signal processor 10. The signal processor 10 includes a highest value acquisition processor 11, the blurring processor 12, a low resolution processor 13, a dimming gradation value determination processor 14, and a gradation value determination processor 15.

The highest value acquisition processor 11 performs highest value acquisition processing. Specifically, the highest value acquisition processor 11 identifies, for each of the pixels 48, a highest gradation value among gradation values of the colors of red (R), green (G), and blue (B) that are contained in the pixel signal given for each of the pixels 48 of the display panel 30 by the input signal IP. For example, when the pixel signal of (R, G, B)=(50, 30, 10) is given for the certain pixel 48, the highest gradation value in the pixel signal is 50. The highest value acquisition processor 11 performs the above-mentioned processing of identifying the highest gradation value for each pixel signal that is given individually for each pixel 48.

The blurring processor 12 performs the blurring processing. Specifically, the blurring processor 12 provisionally applies the highest gradation value to a pixel 48 (hereinafter, referred to as a highest pixel 48) as the degree of light transmission at the highest pixel 48. The highest gradation value is identified by the highest value acquisition processor 11. The pixel signal given to the highest pixel 48 contains the highest gradation value. The blurring processor 12 provisionally applies the degrees of light transmission to other pixels 48 located around the highest pixel 48, in such a manner that the degrees of light transmission at the other pixels 48 are lowered as the distance from the highest pixel 48 is increased. As a more specific example, the blurring processor 12 provisionally applies the degrees of light transmission at the pixels 48 such that control of the gradation values is established with the same concept as that of the control of the degrees of light transmission through the respective dimming pixels 148. The degrees of light transmission through the respective dimming pixels 148 are determined based on the distances between the respective dimming pixels 148 and the coordinate "0" as explained with reference to the graph in FIG. 6. In the following, an expression "provisional gradation value" indicates the degree of light transmission that is provisionally applied by the blurring processor 12. The gradation (i.e., the number of bits) of the provisional gradation value is the same as the gradation (i.e., the number of bits) of each color in the pixel signal.

Figure 10:
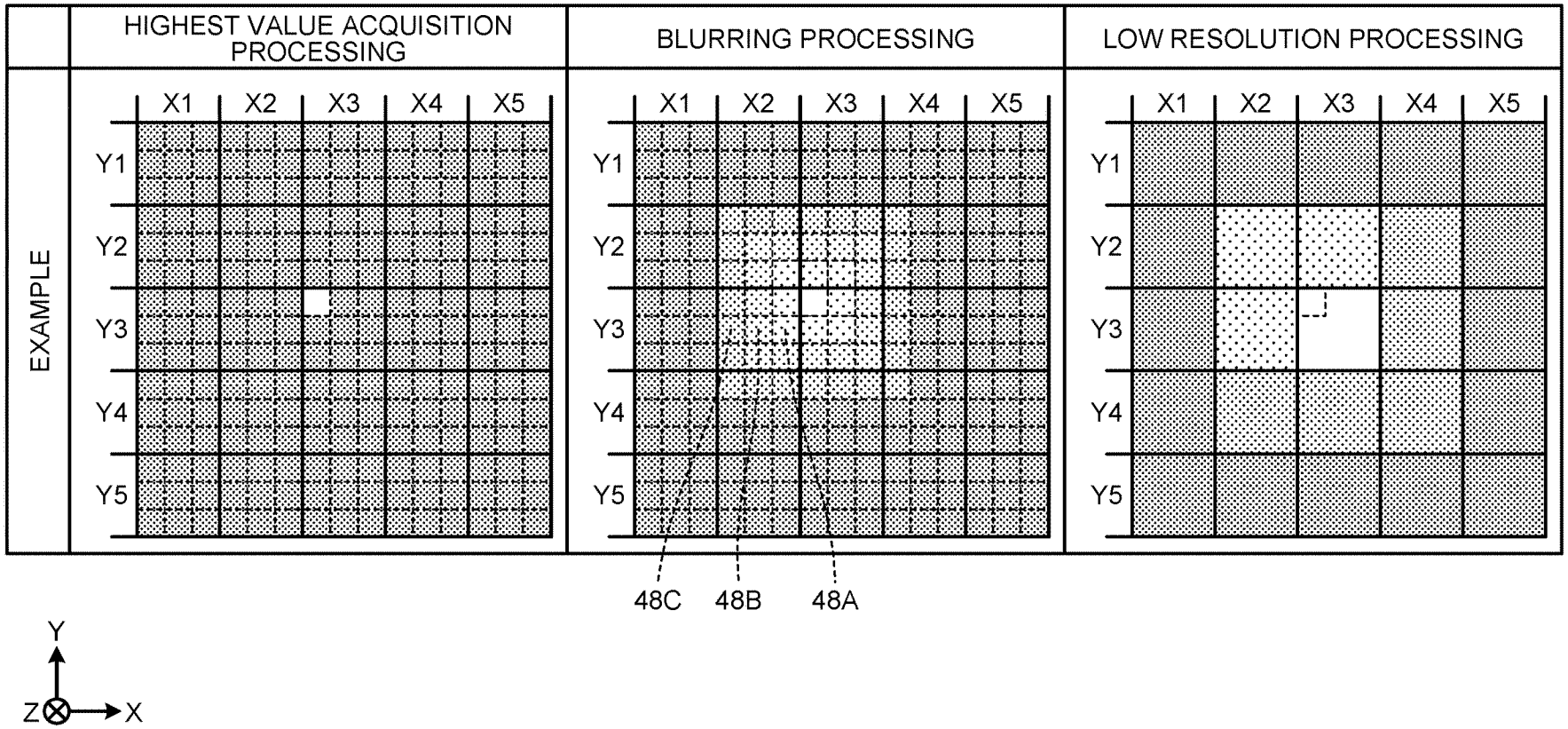
FIG. 10 is a schematic view illustrating Example as an example of flow of highest value acquisition processing, the blurring processing, and low resolution processing by the signal processor according to the first embodiment.

FIG. 10 is a schematic view illustrating Example as an example of flow of the highest value acquisition processing, the blurring processing, and low resolution processing by the signal processor 10 in the first embodiment. In FIG. 10, X coordinates (X1, X2, X3, X4, and X5) are given for the purpose of distinguishing positions, in the X direction, of 5×5 of the dimming pixels 148 arranged in a matrix with a row-column configuration along the X-Y plane. In FIG. 10, Y-coordinates (Y1, Y2, Y3, Y4, and Y5) are given for the purpose of distinguishing positions, in the Y-direction, of 5×5 of the dimming pixels 148 arranged in a matrix with a row-column configuration along the X-Y plane. A combination of the X coordinate and the Y coordinate is expressed in the form of (Xm, Yn). m and n are natural numbers in a range of 1 to 5. For example, the dimming pixel 148 at (X3, Y3) indicates the dimming pixel 148 whose X coordinate is X3 and Y coordinate is Y3.

In addition, since 3×3 of the pixels 48 are located in the region of one dimming pixel 148 as described above, expressions of "upper left", "upper center", "upper right", "center left", "center", "center right", "lower left", "lower center", and "lower right" are used in order to distinguish the positions of the pixels 48 in the region of the dimming pixel 148 at certain coordinates. The expression "center" indicates the position of the pixel 48 overlapping with the center of one dimming pixel 148. The expression "upper center" indicates the position of the pixel 48 adjacent to the pixel 48 at the "center" on the upper side thereof. The expression "lower center" indicates the position of the pixel 48 adjacent to the pixel 48 at the "center" on the lower side thereof. The expression "center left" indicates the position of the pixel 48 adjacent to the pixel 48 at the "center" on the left side thereof. The expression "center right" indicates the position of the pixel 48 adjacent to the pixel 48 at the "center" on the right side thereof. The expression "upper left" indicates the position of the pixel 48 adjacent to the pixel 48 at the "center left" on the upper side thereof. The expression "lower left" indicates the position of the pixel 48 adjacent to the pixel 48 at the "center left" on the lower side thereof. The expression "upper right" indicates the position of the pixel 48 adjacent to the pixel 48 at the "center right" on the upper side thereof. The expression "lower right" indicates the position of the pixel 48 adjacent to the pixel 48 at the "center right" on the lower side thereof.

The "Highest Value Acquisition Processing" in "Example" illustrated in FIG. 10 indicates an example in which, by the identification of the highest gradation value, it is determined that the pixel 48 at the "upper left" in the dimming pixel 148 at (X3,Y3) is in a state of transmitting light and the other dimming pixels 148 are in a state of not transmitting light. In other words, in Example illustrated in FIG. 10, such an input signal IP is input to the display device 1.

Based on the above-mentioned states of the "Highest Value Acquisition Processing" in "Example", in the "Blurring Processing" in "Example", the blurring processor 12 sets the pixel 48 at the "upper left" in (X3,Y3) as a reference (center) pixel of the blurring processing and applies a provisional gradation value to each of the pixels 48A as eight pixels 48 adjacent to the reference pixel 48 in the X direction, the Y direction, and the diagonal directions. The eight pixels 48 are located at the "lower right" in (X2,Y2), at the "lower left" and the "lower center" in (X3,Y2), at the "upper right" and the "center right" in (X2,Y3), and at the "upper center", the "center left", and the "center" in (X3, Y3). The provisional gradation value applied to each of the eight pixels 48 is referred to as a first provisional gradation value.

In the "Blurring Processing" in "Example", the blurring processor 12 applies a provisional gradation value to each of the pixels 48B as 16 pixels 48 located around the outer periphery of the eight pixels 48 to which the first provisional gradation value is applied and adjacent to at least one of the eight pixels 48. The 16 pixels 48 are located at the "center", the "center right", and the "lower center" in (X2,Y2), at the "center left", the "center", the "center right", and the "lower right" in (X3,Y2), at the "upper center", the "center", the "lower center", and the "lower right" in (X2,Y3), and at the "upper right", the "center right", the "lower left", the "lower center", and the "lower right" in (X3,Y3). The provisional gradation value applied to each of the 16 pixels 48 is referred to as a second provisional gradation value.

In the "Blurring Processing" in "Example", the blurring processor 12 applies a provisional gradation value to each of the pixels 48C as 24 pixels 48 located around the outer periphery of the 16 pixels 48 to which the second provisional gradation value is applied and adjacent to at least one of the 16 pixels 48. The 24 pixels 48 are at the "upper left", the "upper center", the "upper right", the "center left", and the "lower left" in (X2,Y2), at the "upper left", "upper center", and the "upper right" in (X3,Y2), at the "upper left", the "center left", and the "lower left" in (X4,Y2), at the "upper left", the "center left", and the "lower left" in (X2,Y3), at the "upper left", the "center left", and the "lower left" in (X4,Y3), at the "upper left", the "upper center", and the "upper right" in (X2,Y4), at the "upper left", the "upper center", and the "upper right" in (X3,Y4), and at the "upper left" in (X4,Y4). The provisional gradation value applied to each of the 24 pixels 48 is referred to as a third provisional gradation value.

The first provisional gradation value is a higher than the second provisional gradation value and the third provisional gradation value. That is to say, the degree of light transmission with the first provisional gradation value is higher than the degree of light transmission with the second provisional gradation value and the degree of light transmission with the third provisional gradation value. The second provisional gradation value is higher than the third provisional gradation value.

When the degree of light transmission with the highest gradation value contained in the pixel signal given for the pixel 48 to which the provisional gradation value is applied is higher than that with the provisional gradation value applied by the blurring processing, the highest gradation value takes priority over the provisional gradation value in actual display output, and control based on the provisional gradation value is not applied.

The low resolution processor 13 illustrated in FIG. 9 performs low resolution processing. Specifically, the low resolution processor 13 converts data after the blurring processing by the blurring processor 12, into data corresponding to the number and arrangement of dimming pixels 148. The data after the blurring processing by the blurring processor 12 is data corresponding to the number and arrangement of pixels 48 based on the input signal IP and is data in which either the highest gradation values of the respective pixels 48 that have been identified by the highest value acquisition processing by the highest value acquisition processor 11 or the provisional gradation values applied in the blurring processing by the blurring processor 12, whichever values are higher, are reflected to the respective pixels 48.

More specifically, the low resolution processor 13 adopts, as the gradation value of one dimming pixel 148, the highest value among the gradation values (the highest gradation values or the provisional gradation values) set for the respective pixels 48 (of 3×3, for example) included in the area overlapping with the one dimming pixel 148 in the planar viewpoint in the data after the blurring processing by the blurring processor 12. The low resolution processor 13 adopts such a gradation value for each of the dimming pixels 148 included in the dimming panel 80.

In Example illustrated in FIG. 10, patterns corresponding to the gradation values that are equivalent to those of the highest values among the gradation values (the highest gradation values or the provisional gradation values) set for the respective pixels 48 of 3×3 in each dimming pixel 148 in the "Blurring Processing" in "Example" are illustrated as a result of the "Low Resolution Processing" in "Example".

For example, in (X3,Y3), the gradation value of the pixel 48 at the "upper left" as the reference (center) of the blurring processing is the highest. Therefore, the same pattern (white pattern) as that of the pixel 48 at the "upper left" in the image of the "Blurring Processing" in "Example" is reflected in that in the "Low Resolution Processing" in "Example".

In the "Low Resolution Processing" in "Example", the same pattern as that of the pixel 48 at the "upper left" in (X3,Y3) in the "Highest Value Acquisition Processing" is illustrated at the position of the "upper left" in (X3,Y3) in the "Low Resolution Processing" in order to indicate the position of the pixel 48 at the "upper left". This is a pattern serving as a mark, but it does not indicate that the upper left in the dimming pixel 148 is controlled in a different manner from the other locations in the "Low Resolution Processing". In practice, the entire area within the dimming pixel 148 after the "Low Resolution Processing" is uniformly controlled so as to correspond to one gradation.

In each of (X2,Y2), (X3,Y2), and (X2,Y3), the first provisional gradation value is the highest, and thus the same pattern (dot pattern with a relatively low density) as that of the pixels 48A in the image of the "Blurring Processing" in "Example" is reflected in the "Low Resolution Processing" in "Example".

In each of (X4,Y2), (X4,Y3), (X2,Y4), (X3,Y4), and (X4,Y4), the third provisional gradation value is the highest, and thus the same pattern (dot pattern with a relatively high density) as that of the pixels 48C in the image of the "Blurring Processing" in "Example" is reflected in the "Low Resolution Processing" in the "Example".

The dimming gradation value determination processor 14 illustrated in FIG. 9 derives dimming gradation values of the respective dimming pixels 148 on the basis of the values adopted as the gradation values of the respective dimming pixels 148 by the low resolution processor 13. Specifically, the dimming gradation value determination processor 14 performs processing of deriving the dimming gradation value corresponding to the value adopted as the gradation value of the dimming pixel 148 with reference to a previously prepared look-up table (LUT) and setting the derived value as the dimming gradation value of the dimming pixel 148. The dimming gradation value determination processor 14 performs the processing individually for each of the dimming pixels 148 included in the dimming panel 80. A signal indicating the dimming gradation values of the respective dimming pixels 148 that have been derived by the dimming gradation value determination processor 14 is output as the dimming signal DI to the signal output circuit 141. The signal output circuit 141 controls output to the dimming pixels 148 such that the dimming pixels 148 transmit light at the degrees of light transmission corresponding to the dimming gradation values.

Figure 11:
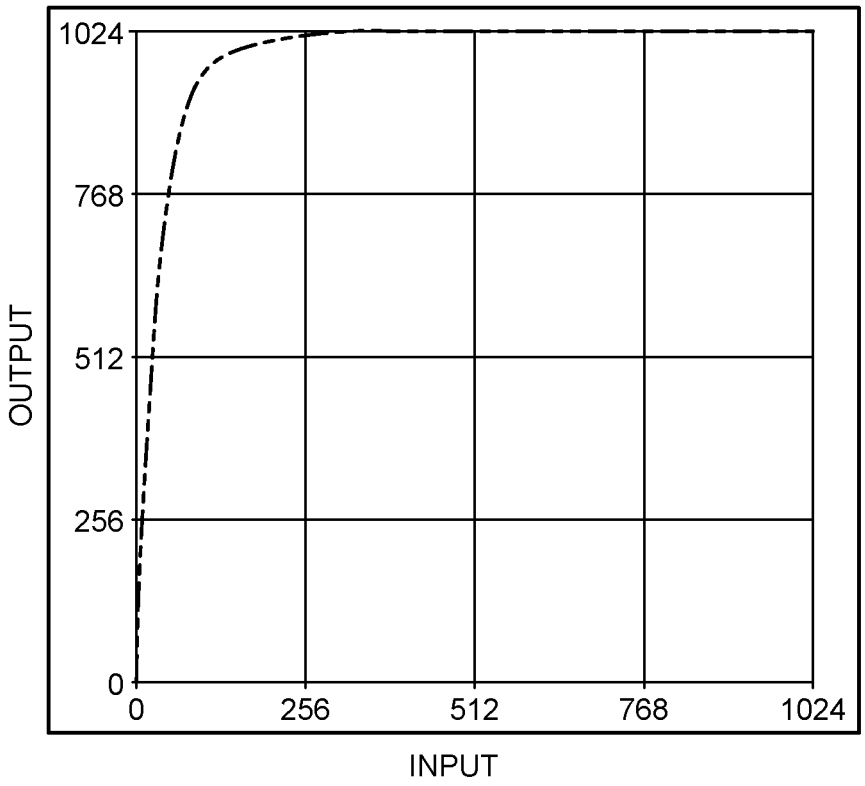
FIG. 11 is a graph illustrating a correspondence relation between input and output of a dimming gradation value determination processor.

FIG. 11 is a graph illustrating a correspondence relation between input and output of the dimming gradation value determination processor 14. The input in the input and the output indicates the value adopted as the gradation value of one dimming pixel 148 by the low resolution processing by the low resolution processor 13. The output indicates the dimming gradation value derived based on the input with reference to the LUT by the dimming gradation value determination processor 14. In other words, the LUT corresponding to the input and the output is previously recorded in the signal processor 10 such that the LUT can be referred to by the dimming gradation value determination processor 14. FIG. 11 and FIGS. 22, 23, 24, 28, and 29, which will be described later, exemplify the case where values of the input and the output are managed as values of 10 bits. The number of bits for managing the values of the input and the output is, however, not limited thereto and can be appropriately changed.

As illustrated in FIG. 11, the LUT is set such that the output is equal to or higher than the input in the correspondence relation between the input and the output of the dimming gradation value determination processor 14. In particular, when the value of the input exceeds 256, the value of the output is a highest value or extremely close to the highest value. When the value of the input exceeds 600, the value of the output is the highest value regardless of the magnitude of the input value.

The gradation value determination processor 15 illustrated in FIG. 9 determines the gradation values of the sub pixels (for example, the first sub pixel 49R, the second sub pixel 49G, and the third sub pixel 49B) included in the pixel 48 based on the gradation values indicated by the pixel signal and the dimming gradation value of a dimming pixel 148. The pixel signal is contained in the input signal IP. The dimming pixel 148 corresponds to the pixel 48 that is given the pixel signal (i.e., the dimming pixel 148 is a dimming pixel the optical axis LL of which coincides with the optical axis of the pixel 48).

As a specific example, it is assumed that RGB gradation values indicated by the pixel signal contained in the input signal IP are (R, G, B)=(Rin, Gin, Bin). In addition, it is assumed that the dimming gradation value of the dimming pixel 148 corresponding to a pixel 48 that is given the pixel signal (i.e., a dimming pixel 148 the optical axis LL of which coincides with the optical axis of the pixel 48) is Wout. In the embodiment, the gradation value determination processor 15 calculates Rin', Gin', and Bin' based on Rin, Gin, and Bin, MAX, and a predetermined correction factor (for example, ^2.2) by using the following Equations (1), (2), and (3). MAX indicates the highest value among values that can be expressed with the number of bits for representing the dimming gradation value of the dimming pixel 148. For example, when the dimming gradation value of the dimming pixel 148 is 10 bits, MAX is 1023. The expression "^n" indicates that a relation between the input (right side) and the output (left side) is conversion in accordance with a gamma curve of 1:n. The gradation value determination processor 15 calculates Wout' based on Wout, MAX, and the correction factor by using the following Equation (4). The gradation value determination processor 15 calculates a gradation value (Rout) of the first sub pixel 49R included in the pixel 48 by using the following Equations (5) and (8). The gradation value determination processor 15 calculates a gradation value (Gout) of the second sub pixel 49G included in the pixel 48 by using the following Equations (6) and (9). The gradation value determination processor 15 calculates a gradation value (Bout) of the third sub pixel 49B included in the pixel 48 by using the following Equations (7) and (10). The gradation value determination processor 15 sets the calculated values (R, G, B)=(Rout, Gout, Bout) as the RGB gradation values of the pixel 48. The gradation value determination processor 15 performs the processing of determining the RGB gradation values in the above-mentioned manner individually for each of the pixels 48 included in the display panel 30.

$$Rin'=(Rin/\mathrm{MAX})\hat{}2.2 \quad (1)$$

$$Gin'=(Gin/\mathrm{MAX})\hat{}2.2 \quad (2)$$

$$Bin'=(Bin/\mathrm{MAX})\hat{}2.2 \quad (3)$$

$$\mathrm{Wout}'=(\mathrm{Wout}/\mathrm{MAX})\hat{}2.2 \quad (4)$$

$$\mathrm{Rout}'=Rin'/\mathrm{Wout}' \quad (5)$$

$$\mathrm{Gout}'=Gin'/\mathrm{Wout}' \quad (6)$$

$$\mathrm{Bout}'=Bin'/\mathrm{Wout}' \quad (7)$$

$$\mathrm{Rout}=\mathrm{MAX}\times\mathrm{Rout}'\hat{}(1/2.2) \quad (8)$$

$$\mathrm{Gout}=\mathrm{MAX}\times\mathrm{Gout}'\hat{}(1/2.2) \quad (9)$$

$$\mathrm{Bout}=\mathrm{MAX}\times\mathrm{Bout}'\hat{}(1/2.2) \quad (10)$$

A signal indicating the RGB gradation values of the respective pixels 48 determined by the gradation value determination processor 15 is output to the signal output circuit 41 as the output image signal OP. The signal output circuit 41 controls output to the first sub pixels 49R, the second sub pixels 49G, and the third sub pixels 49B included in the pixels 48 so as to cause the pixels 48 to transmit light with the degrees of light transmission corresponding to the RGB gradation values.

In explanation with reference to FIG. 10, the pixel 48 at the "upper left" in (X3,Y3) is set as the reference (center) of the blurring processing, and the predetermined region to which the "Blurring Processing" is applied has a size corresponding to three pixels 48 in the X directions and three pixels 48 in the Y directions from the center. The predetermined region is merely an example. The number of pixels 48 included in the predetermined region and the distance from the reference of the blurring processing can be appropriately changed.

As described above, in the first embodiment, the blurring processing by the blurring processor 12 is performed before the low resolution processing by the low resolution processor 13. If the low resolution processing is performed before the blurring processing, the dimming gradation values may become undesirable values. The following describes a reference example in which the low resolution processing is performed before the blurring processing with reference to FIG. 12.

Figure 12:
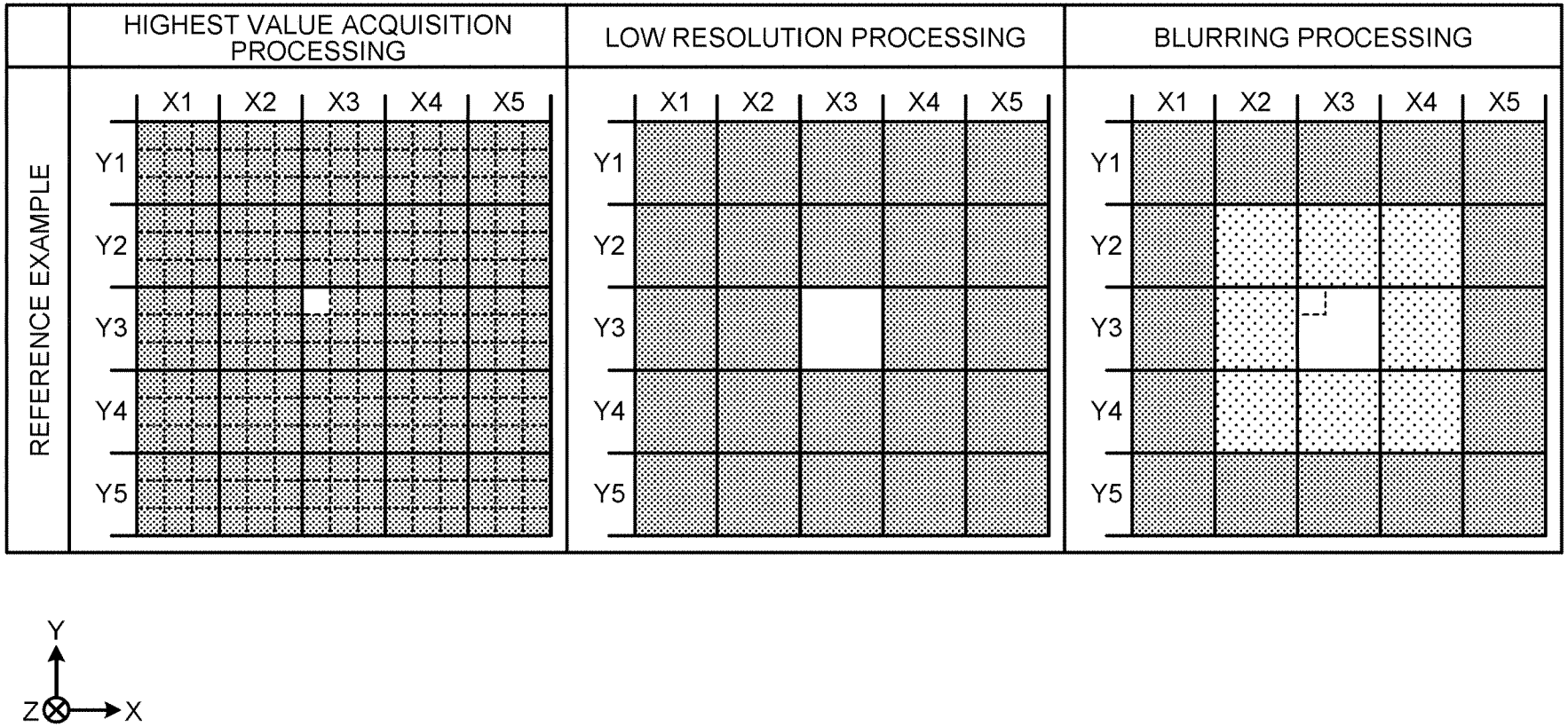
FIG. 12 is a schematic view illustrating flow of highest value acquisition processing, low resolution processing, and blurring processing in a reference example.

FIG. 12 is a schematic view illustrating flow of highest value acquisition processing, low resolution processing, and blurring processing in the reference example. A result of the highest value acquisition processing illustrated in FIG. 12 is similar to that in Example described with reference to FIG. 10.

In the reference example, the low resolution processing is performed after the highest value acquisition processing and before the blurring processing. Therefore, as illustrated in the "Low Resolution Processing" in the "Reference Example" in FIG. 12, the dimming gradation value corresponding to the gradation value of the pixel 48 at the "upper left" in (X3,Y3) that is the only one pixel transmitting light in the "Highest Value Acquisition Processing" is reflected in the dimming pixel 148 at (X3,Y3) in the "Low Resolution Processing". As illustrated in the "Low Resolution Processing" in the "Reference Example" in FIG. 12, the dimming gradation values of the dimming pixels 148 having coordinates other than (X3,Y3) are each in a lowest (dot pattern) state. When the blurring processing is performed after the low resolution processing providing such a result, the dimming gradation values of the dimming pixels 148 adjacent to (X3,Y3) are uniformly increased, as illustrated in the "Blurring Processing" in the "Reference Example" in FIG. 12. As described above, the results provided by performing the "Blurring Processing" and the "Low Resolution Processing" are different between Example and the reference example even when the results provided by performing the "Highest Value Acquisition Processing" are the same. In the reference example, the results that are provided by performing the "Low Resolution Processing" and the "Blurring Processing" become the same regardless of the position of the pixel 48 in (X3,Y3) that transmits light in the "Highest Value Acquisition Processing". That is to say, in the reference example, since the "Low Resolution Processing" is performed before the "Blurring Processing", it is difficult to strictly reflect the position of the pixel 48 transmitting light in the setting of the dimming gradation values.

On the other hand, the "Blurring Processing" is performed before the "Low Resolution Processing" in the first embodiment. As described with reference to FIG. 10, the dimming gradation values preferably reflecting the position of the pixel 48 transmitting light can therefore be derived. For example, when the pixel 48 at the "center" in (X3,Y3) is the only one pixel transmitting light, a similar result to the dimming gradation values after the "Blurring Processing" in the "Reference Example" illustrated in FIG. 12 is obtained also in the first embodiment. It can be regarded that this result is obtained by more appropriately reflecting the state where only the pixel 48 at the "center" in (X3,Y3) transmits light.

Figure 32:
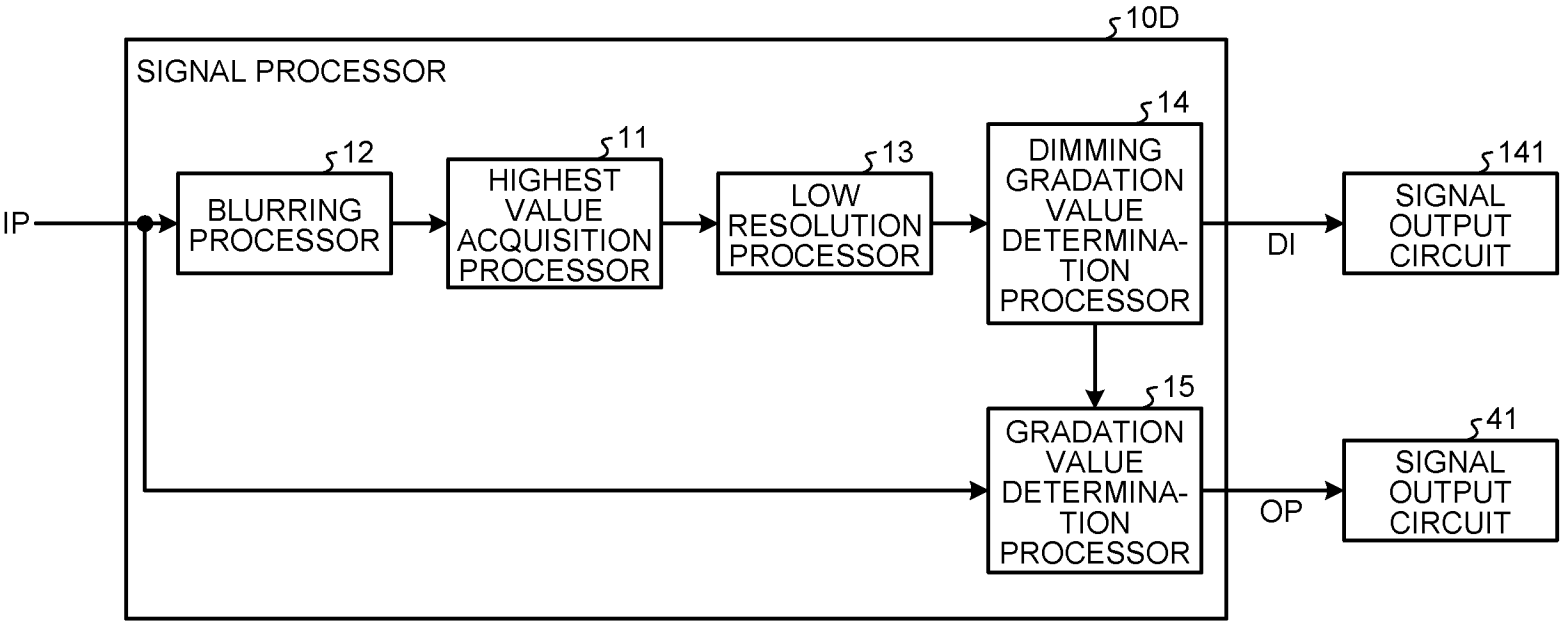
FIG. 32 is a block diagram illustrating a functional configuration of a signal processor and input and output of the signal processor.

As in a signal processor 10D illustrated in FIG. 32, the order of implementation of the highest value acquisition processing and the blurring processing may be the reverse of that implemented by the signal processor 10 illustrated in FIG. 9. In this case as well, similar effects to those obtained by Example can be obtained as long as the highest value acquisition processing and the blurring processing are performed before the low resolution processing.

Second Embodiment

Figure 13:
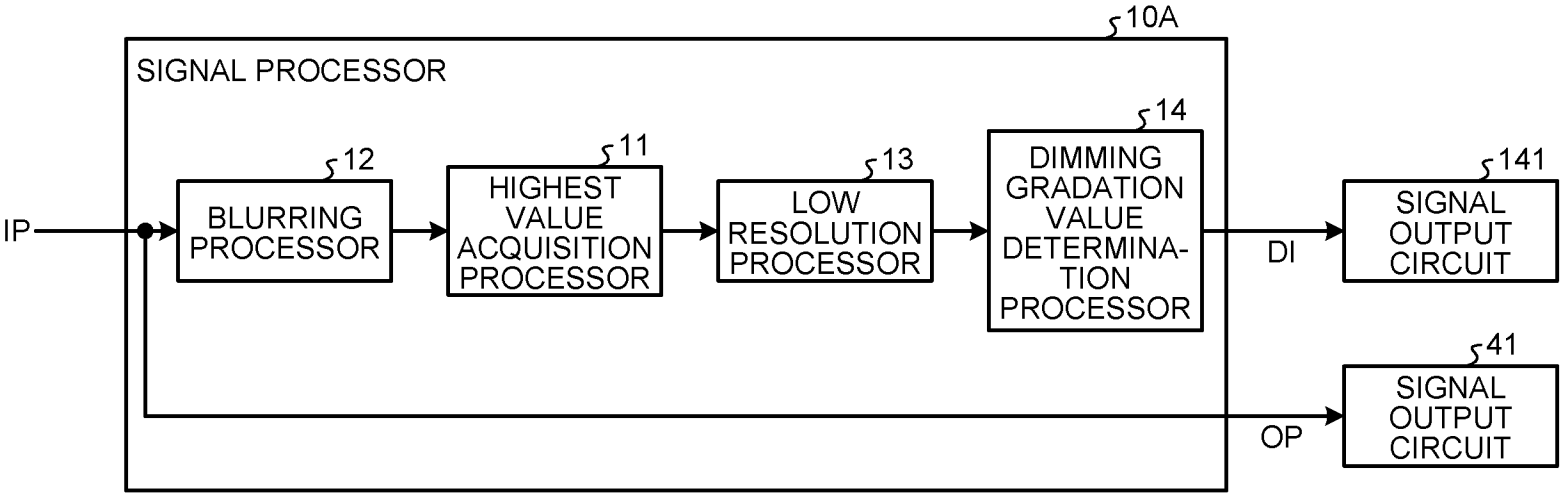
FIG. 13 is a block diagram illustrating the functional configuration of a signal processor and input and output of the signal processor according to a second embodiment.

The following describes a second embodiment that differs from the first embodiment in some processing, with reference to FIG. 13. In the description of the second embodiment, the same reference numerals denote similar components to those in the first embodiment, and explanation thereof may be omitted.

FIG. 13 is a block diagram illustrating the functional configuration of a signal processor 10A and input and output of the signal processor 10A according to the second embodiment. In the second embodiment, the signal processor 10A illustrated in FIG. 13 is employed in place of the signal processor 10 in the first embodiment.

In the signal processor 10A, the blurring processing by the blurring processor 12 is performed before the highest value acquisition processing by the highest value acquisition processor 11. That is to say, in the second embodiment, the blurring processing, the highest value acquisition processing, and low resolution acquisition processing are performed in this order before the determination of dimming gradation values that is performed by the dimming gradation value determination processor 14. Specifically, in the signal processor 10A, the blurring processor 12 performs the blurring processing based on each of gradation values of red (R), green (G), and blue (B) that are contained in a pixel signal of the input signal IP. Gradation values depending on distances from a pixel 48 to which the pixel signal is given are thereby given to sub pixels of pixels 48 around the pixel 48 to which the pixel signal is given. This blurring processing is performed individually for each of the colors of the sub pixels. In the signal processor 10A, the highest value acquisition processor 11 performs the highest value specification processing of identifying a highest gradation value among the gradation values of red (R), green (G), and blue (B) that are set for each of the pixels 48 after the blurring processing. Subsequently, the low resolution processing is performed in the signal processor 10A. In the low resolution processing, the low resolution processor 13 performs processing of adopting a highest value among the highest gradation values of the respective pixels 48, each of which has been identified individually for the pixels 48 located in one dimming pixel 148 in the planar viewpoint in the highest value specification processing. The low resolution processor 13 performs such processing individually for each of the dimming pixels 148. The processing by the dimming gradation value determination processor 14 is the same between the first embodiment and the second embodiment.

The gradation value determination processor 15 is omitted in the signal processor 10A. That is to say, the pixel signals of the input signal IP are directly given to the signal output circuit 41 as the pixel signals of the output image signal OP in the second embodiment. This configuration can further reduce the possibility of occurrence of such a phenomenon that an area in which luminance unintendedly increases is viewed by a user viewing an image from an oblique viewpoint with respect to the display device 1. The following describes the phenomenon with reference to FIG. 14 to FIG. 19.

Figure 14:
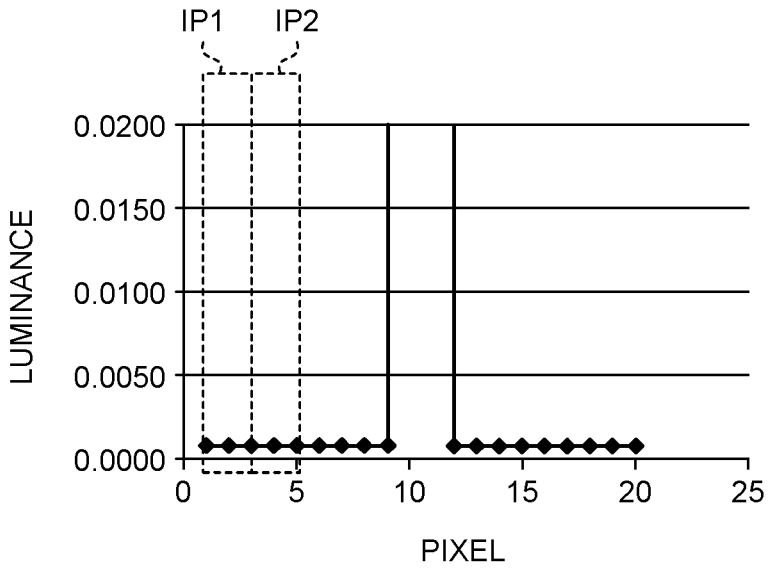
FIG. 14 is a graph illustrating an example of a luminance level pattern that should be produced in output by a plurality of pixels aligned in one direction in accordance with pixel signals of an input signal.

FIG. 14 is a graph illustrating an example of a luminance level pattern that should be produced in output by the pixels 48 aligned in one direction in accordance with the pixel signals of the input signal IP. In other words, in explanation with reference to FIG. 14, when the input signal IP corresponding to the luminance level pattern illustrated in FIG. 14 is received, the display device 1 operates in accordance with the input signal IP. The one direction is the X direction or the Y direction.

As is indicated by the graph illustrated in FIG. 14, the display device 1 receives the input signal IP for controlling the display device 1 such that the luminance of three pixels 48 at the center in one direction among 19 pixels 48 aligned in the one direction is made significantly high and the luminance of the other pixels 48 is made substantially equal to zero.

Figure 15:
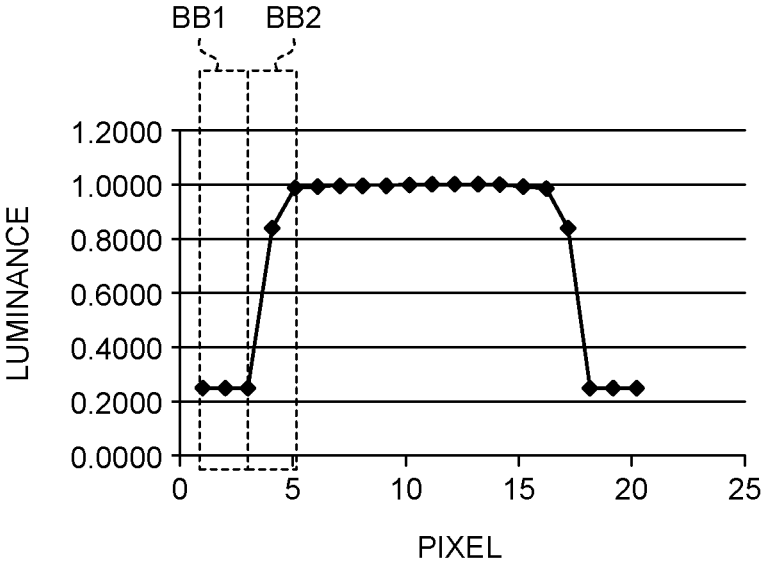
FIG. 15 is a graph illustrating an example of a luminance level pattern of light allowed to pass through a dimming panel controlled in accordance with input of the input signal illustrated in the graph in FIG. 14.

FIG. 15 is a graph illustrating an example of a luminance level pattern of light allowed to pass through the dimming panel 80 controlled in accordance with the input of the input signal IP illustrated in the graph in FIG. 14. The blurring processing described with reference to FIG. 6 to FIG. 8 causes a region where the dimming panel 80 transmits light to be wider than that of the display panel 30. In the example illustrated in FIG. 15, light is transmitted such that a region corresponding to 11 pixels 48 in the region of the pixels 48 aligned in one direction can output light at the highest luminance (1). The region corresponding to the 11 pixels 48 is centered on the three pixels 48 having the significantly high luminance in the graph illustrated in FIG. 14. The dimming pixels 148 are controlled such that relative luminance is the lowest in a region BB1 farthest from the region corresponding to the 11 pixels 48 among the 19 pixels 48 aligned in the one direction described with reference to FIG. 14. The dimming pixels 148 are controlled such that in a region BB2 between the region BB1 and the region corresponding to the 11 pixels 48, the luminance increases as is closer to the region corresponding to the 11 pixels 48 from the region BB1. Although the number of dimming pixels 148 schematically illustrated in the graph in FIG. 15 is the same as that of pixels 48 for the purpose of facilitating understanding of a correspondence relation with the pixels 48, in practice, more than one pixel 48 is included within the region of one dimming pixel 148 as described above.

Figure 16:
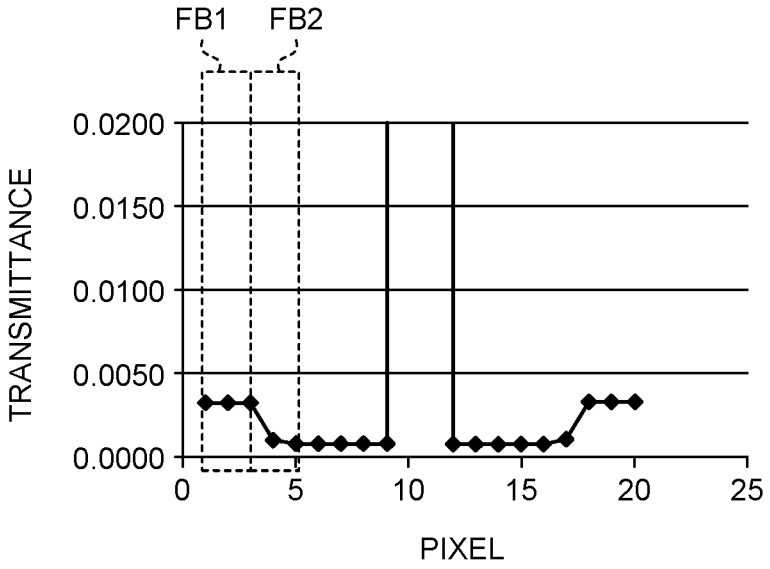
FIG. 16 is a graph illustrating an example of light transmittance control of the pixels based on an output image signal when a gradation value determination processor performs processing.

FIG. 16 is a graph illustrating an example of light transmittance control of the pixels 48 based on the output image signal OP when the gradation value determination processor 15 performs processing. A region IP1 and a region IP2 illustrated in FIG. 14 are desirably controlled such that they are viewed with the same luminance in display output. On the other hand, the region IP1 can transmit light having an optical axis that coincides with the optical axis LL of light passing through the region BB1 illustrated in FIG. 15. The region IP2 can transmit light having an optical axis that coincides with the optical axis LL of light passing through the region BB2 illustrated in FIG. 15. The luminance in the region BB1 is different from the luminance in the region BB2. In the first embodiment, the gradation value determination processor 15 therefore makes the degree of light transmission through the pixels 48 of the display panel 30 different between the region IP1 and the region IP2, so that the region IP1 and the region IP2 can be viewed with substantially the same luminance in the display output. "The region IP1 and the region IP2 can be viewed with substantially the same luminance in the display output" when the display output surface of the display device 1 is viewed from the front side.

Specifically, the gradation value determination processor 15 increases the light transmittance of the pixels 48 included in a region FB1 to be higher than the light transmittance of the pixels 48 included in a region FB2, as illustrated in FIG. 16. The pixels 48 included in the region FB1 are identical to the pixels 48 included in the region IP1 illustrated in FIG. 14. The pixels 48 included in the region FB2 are identical to the pixels 48 included in the region IP2 illustrated in FIG. 14.

Apparent luminance resulting from a combination of the light transmittance of the pixels 48 included in the region FB1 illustrated in FIG. 16 and the luminance in the region BB1 illustrated in FIG. 15 is defined as first luminance. Apparent luminance resulting from a combination of the light transmittance of the pixels 48 included in the region FB2 illustrated in FIG. 16 and the luminance in the region BB2 illustrated in FIG. 15 is defined as second luminance. The first luminance and the second luminance are visually recognized as substantially the same luminance. The relation between the first luminance and the second luminance is preferably established when the display output surface of the display device 1 is viewed from the front side.

Figure 17:
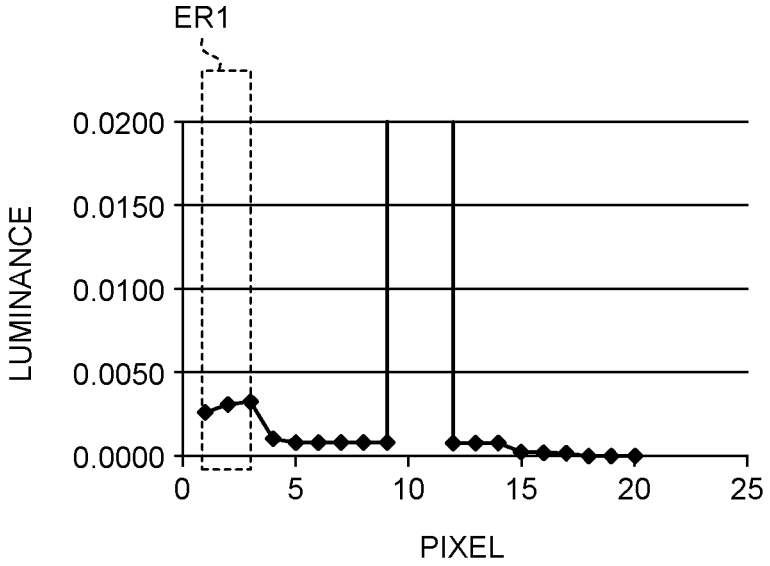
FIG. 17 is a graph illustrating an example of unintended increase in luminance that occurs when viewed from an oblique viewpoint.

FIG. 17 is a graph illustrating an example of unintended increase in the luminance that occurs when viewed from the oblique viewpoint. Assume that the user's viewpoint is the oblique viewpoint where the visual line from the user passes through the region FB1 in the display panel 30 and the region BB2 in the dimming panel 80. Apparent luminance resulting from a combination of the light transmittance of the pixels 48 included in the region FB1 illustrated in FIG. 16 and the luminance in the region BB2 illustrated in FIG. 15 is viewed in this oblique viewpoint. When the apparent luminance is referred to as third luminance, the third luminance is higher than the above-mentioned first luminance and second luminance. A region ER1 where the luminance appears to be locally increased is therefore generated unintendedly as illustrated in FIG. 17.

The processing by the gradation value determination processor 15 is omitted in the second embodiment in consideration of the possibility of occurrence of the unintended increase in the luminance as explained with reference to FIG. 17. That is to say, when the input signal IP explained with reference to FIG. 14 is received, the output image signal OP in the second embodiment is the same as the input signal IP.

Figure 18:
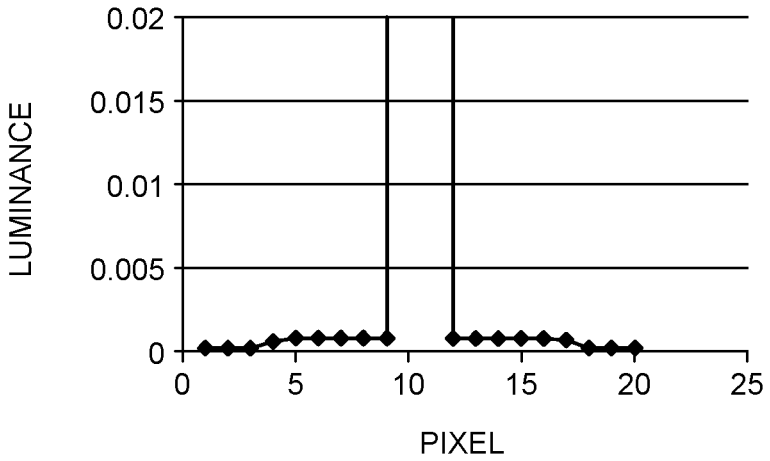
FIG. 18 is a graph illustrating apparent luminance when a display output in the second embodiment in accordance with the input signal illustrated in FIG. 14 is viewed from the front side.

FIG. 18 is a graph illustrating apparent luminance when display output in the second embodiment in accordance with the input signal IP illustrated in FIG. 14 is viewed from the front side. In the second embodiment, the control of the display panel 30 so as to cause the difference between the region FB1 and the region FB2 explained with reference to FIG. 16 is not performed because the processing by the gradation value determination processor 15 is omitted. Thus, the difference between the luminance in the region BB1 and the luminance in the region BB2 as explained with reference to FIG. 15 slightly appears in the apparent luminance in the second embodiment. However, the difference between the luminance in the region BB1 and the luminance in the region BB2 is not so obvious that it impairs the image quality.

Figure 19:
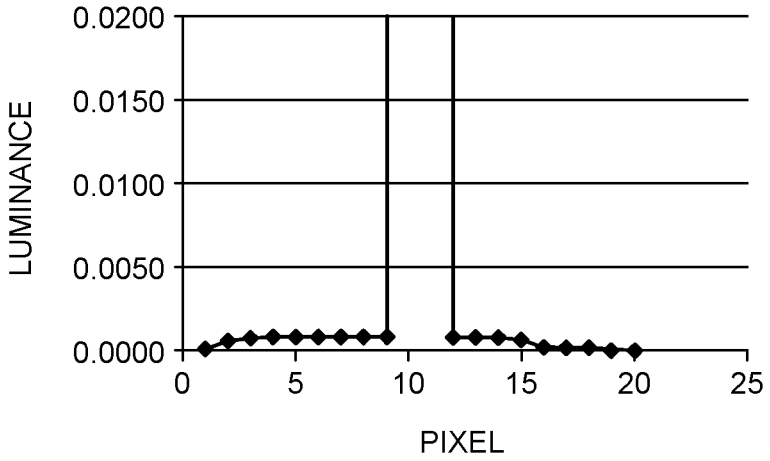
FIG. 19 is a graph illustrating apparent luminance when the display output in the second embodiment is viewed in the oblique viewpoint corresponding to FIG. 17.

FIG. 19 is a graph illustrating apparent luminance when the display output in the second embodiment is viewed in the oblique viewpoint corresponding to FIG. 17. As illustrated in FIG. 19, no unintended local increase in the luminance as in the region ER1 explained with reference to FIG. 17 is generated in the second embodiment. As described above, according to the second embodiment, it is further possible to reduce the possibility of occurrence of such a phenomenon that the area in which the luminance unintendedly increases is visually recognized by the user viewing the image from the oblique viewpoint with respect to the display device 1. As described above, the second embodiment is the same as the first embodiment except for the specially mentioned matters.

Third Embodiment

Hereinafter, a third embodiment that differs from the first embodiment and the second embodiment in some processing is explained. In explanation of the third embodiment, the same reference numerals denote similar components to those in at least one of the first embodiment and the second embodiment, and explanation thereof may be omitted.

First, as a premise of technical characteristics of the third embodiment, limits of color reproduction in a liquid crystal display is explained with reference to FIG. 20.

Figure 20:
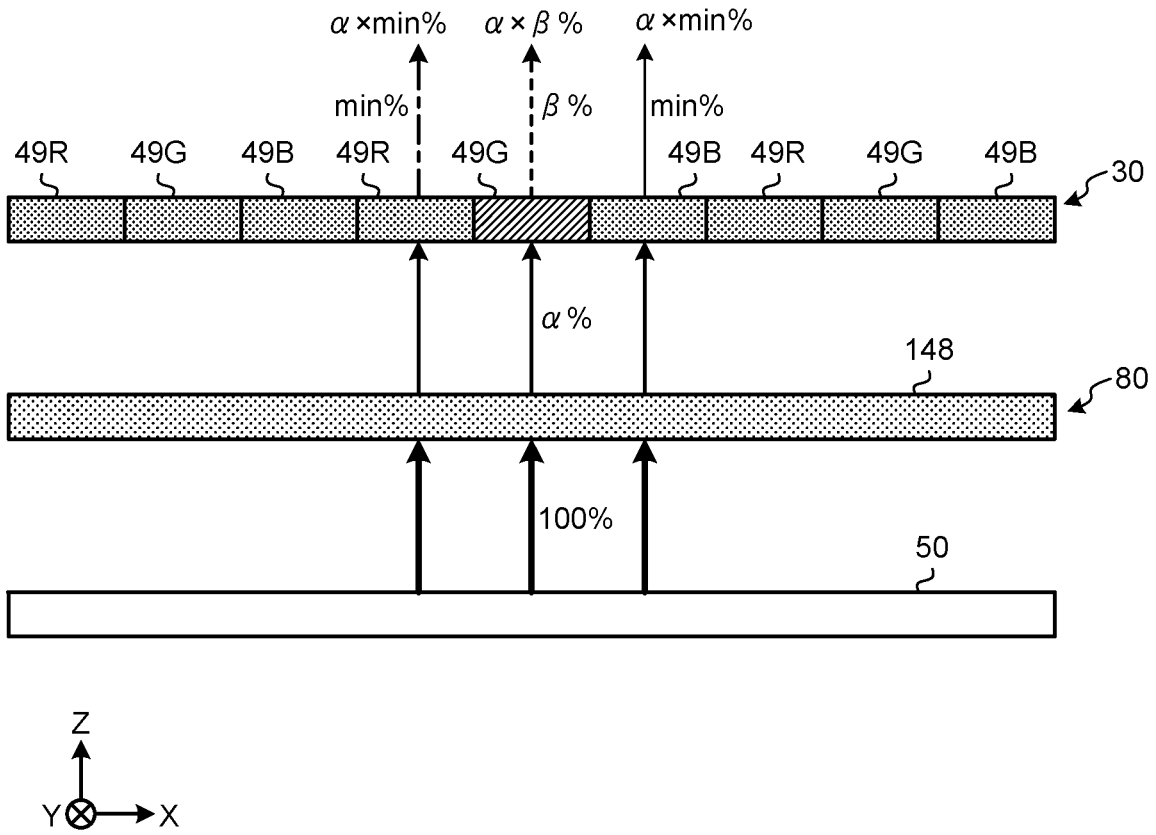
FIG. 20 is a schematic view illustrating a case where among first sub pixels, second sub pixels, and third sub pixels, only a second sub pixel is controlled to transmit light.

FIG. 20 is a schematic view illustrating a case where only the second sub pixel 49G is controlled to transmit light among the first sub pixels 49R, the second sub pixels 49G, and the third sub pixels 49B. In the liquid crystal display like the display device 1, the display panel 30 transmits light from the light source device 50, which is emitted thereto from the opposite side to the display output surface, to reproduce an image. In the display device 1, the dimming panel 80 interposed between the display panel 30 and the light source device 50 adjusts the luminance of light to be applied to the pixels 48 of the display panel 30.

If no dimming panel 80 is provided, the pixels 48 are almost equally irradiated with light emitted from the light source device 50 to the display panel 30. Even when the dimming panel 80 is provided as in the display device 1, the smallest unit by which light from the light source device 50 to the display panel 30 is adjusted, is an area unit of each dimming pixel 148. Thus, light to be applied to each of the first sub pixel 49R, the second sub pixel 49G, and the third sub pixel 49B included in one pixel 48 is not individually controlled.

It is assumed that only one second sub pixel 49G is controlled to transmit light and the other sub pixels such as the first sub pixels 49R and the third sub pixels 49B are controlled not to transmit light, as illustrated in FIG. 20. It is assumed that light emitted from the light source device 50 is light of 100% and the degree of light transmission controlled by the dimming pixel 148 of the dimming panel 80 is a %. When one second sub pixel 49G is controlled such that the degree of light transmission is β%, the user views light of α×β% at a position of the one second sub pixel 49G. The first sub pixel 49R and the third sub pixels 49B adjacent to the one second sub pixel 49G are controlled such that the degree of light non-transmission is the highest. Even when the first sub pixel 49R and the third sub pixels 49B controlled in such a manner, the degrees of light transmission thereof are not 0%. In FIG. 20, the degrees of light transmission of the first sub pixel 49R and the third sub pixels 49B controlled in such a manner are min %. Thus, the user views light of α×min % at the positions of the first sub pixel 49R and the third sub pixels 49B.

As the luminance of light of α×β% that the user views at the position of the second sub pixel 49G is higher, it is relatively harder for the user to view the first sub pixel 49R and the third sub pixel 49B where light of α×min % is output. As the luminance of the second sub pixel 49G is controlled to be higher, a reproduced color is closer to a correct color when viewed on a pixel 48 basis. The "correct color" is a color that faithfully corresponds to an R:G:B ratio of the RGB gradation values indicated by the pixel signal of the input signal IP.

Conversely, as the luminance of light of α×β% viewed by the user at the position of the second sub pixel 49G is lower, relative influences given by the first sub pixel 49R and the third sub pixel 49B where light of α×min % is output relatively increase. The liquid crystal display therefore tends to be increased in error between the reproduced color and the correct color as the luminance is lower.

Although only the second sub pixel 49G transmits light as the example in FIG. 20, even when only the first sub pixel 49R or only the third sub pixel 49B transmits light, light passing through the sub pixels of the other colors cannot be set to 0%, which similarly causes error between a reproduced color and a correct color.

The third embodiment further incorporates control for more reducing the error between the reproduced color and the correct color while taking the above-mentioned tendency of the liquid crystal display into consideration.

Figure 21:
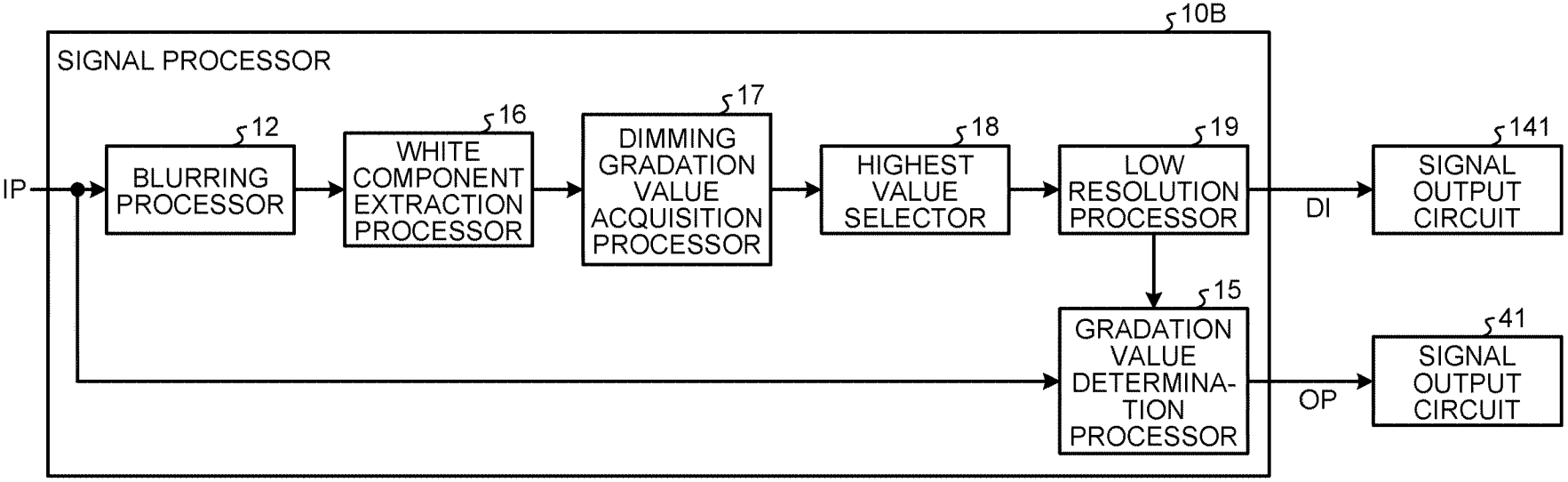
FIG. 21 is a block diagram illustrating the functional configuration of a signal processor and input and output of a signal processor according to a third embodiment.

FIG. 21 is a block diagram illustrating the functional configuration of a signal processor 10B and input and output of the signal processor 10B according to the third embodiment. In the third embodiment, the signal processor 10B illustrated in FIG. 21 is employed in place of the signal processor 10 in the first embodiment.

The signal processor 10B includes the blurring processor 12, a white component extraction processor 16, a dimming gradation value acquisition processor 17, a highest value selector 18, a low resolution processor 19, and the gradation value determination processor 15. The blurring processor 12 included in the signal processor 10B performs similar processing to that by the blurring processor 12 included in the signal processor 10A in the second embodiment.

The white component extraction processor 16 performs processing of extracting gradation values that can be handled as a white component among RGB gradation values set for each of the pixels 48 after the blurring processing by the blurring processor 12. The white component extraction processor 16 performs the extraction processing individually for each of the pixels 48 included in the display panel 30. Specifically, the white component extraction processor 16 identifies a lowest gradation value (Wa) among a gradation value (Ra) of red (R), a gradation value (Ga) of green (G), and a gradation value (Ba) of blue (B) that are included in the RGB gradation values (R, G, B)=(Ra, Ga, Ba). The white component extraction processor 16 then sets (R, G, B)=(Wa, Wa, Wa) among the RGB gradation values as the gradation values that can be handled as the white component.

The dimming gradation value acquisition processor 17 acquires dimming gradation values corresponding to the respective colors from the gradation values that can be handled as the white component derived by the white component extraction processor 16 and the gradation values of the respective colors that are included in the RGB gradation values from which the white component has been derived. That is to say, the dimming gradation value acquisition processor 17 performs processing of acquiring the dimming gradation value of white, the dimming gradation value of red, the dimming gradation value of green, and the dimming gradation value of blue based on the processing result by the white component extraction processor 16. The dimming gradation value acquisition processor 17 performs the acquisition processing individually for each of the pixels 48 included in the display panel 30.

Specifically, the dimming gradation value acquisition processor 17 uses, as input, the gradation value that can be handled as the white component derived by the white component extraction processor 16 and the gradation values of the respective colors that are included in the RGB gradation values from which the white component has been derived, refers to a previously prepared LUT, and acquires and outputs the dimming gradation values corresponding to the input for the respective colors. In other words, the LUT corresponding to the input and the output is recorded in the signal processor 10B in advance so as to be able to be referred to by the dimming gradation value acquisition processor 17.

Figure 22:
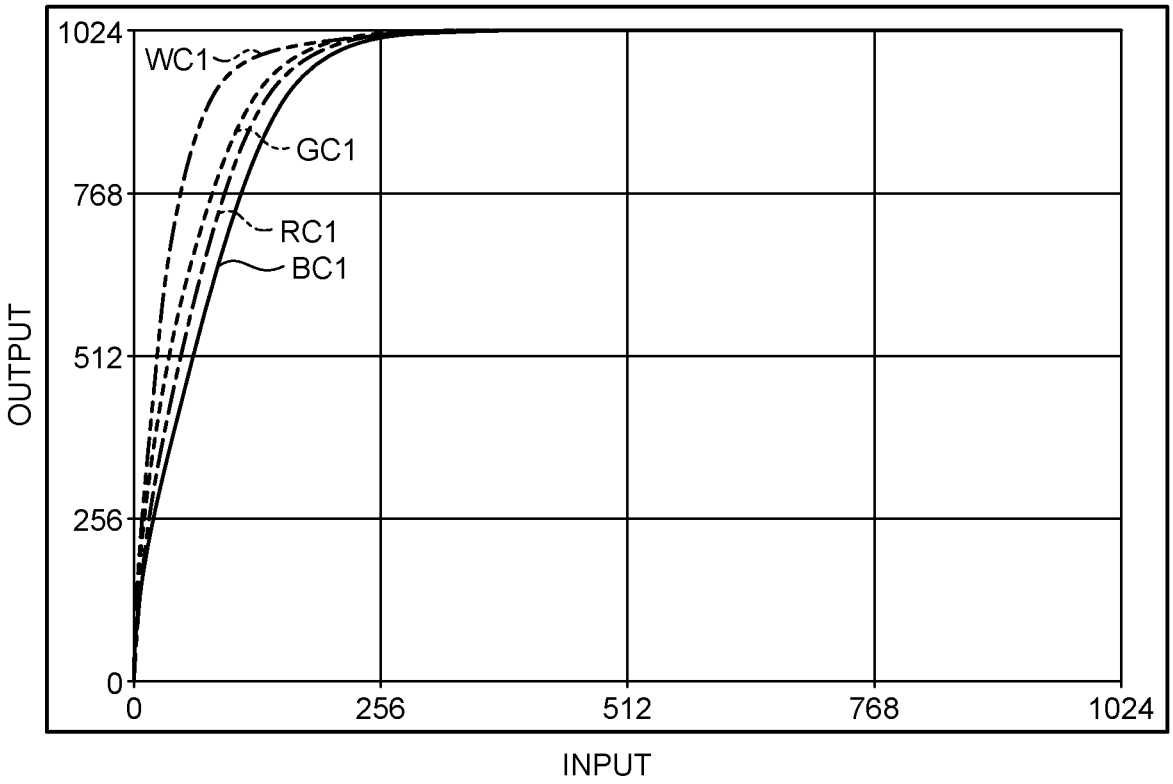
FIG. 22 is a graph illustrating an example of correspondence relations between input and output of a dimming gradation value acquisition processor.

FIG. 22 is a graph illustrating an example of correspondence relations between the input and the output of the dimming gradation value acquisition processor 17. The dimming gradation value acquisition processor 17 acquires the dimming gradation value of white from the gradation value (Wa) that can be handled as the white component derived by the white component extraction processor 16, in accordance with the input-output correspondence relation indicated by a graph WC1 in FIG. 22. The dimming gradation value acquisition processor 17 acquires the dimming gradation value of red from the gradation value (Ra) of red that is included in the RGB gradation values from which the white component has been derived, in accordance with the input-output correspondence relation indicated by a graph RC1 in FIG. 22. The dimming gradation value acquisition processor 17 acquires the dimming gradation value of green from the gradation value (Ga) of green that is included in the RGB gradation values, in accordance with the input-output correspondence relation indicated by a graph GC1 in FIG. 22. The dimming gradation value acquisition processor 17 acquires the dimming gradation value of blue from the gradation value (Ba) of blue that is included in the RGB gradation values, in accordance with the input-output correspondence relation indicated by a graph BC1 in FIG. 22. The LUT that is referred to in the processing by the dimming gradation value acquisition processor 17 thus indicates the different input-output correspondence relations for white, red, green, and blue. The LUT indicates that the higher dimming gradation value is more likely to be acquired in the order of white, green, red, and blue when the input gradation values thereof are the same.

The highest value selector 18 illustrated in FIG. 21 performs processing of identifying a highest dimming gradation value among the dimming gradation value of white, the dimming gradation value of red, the dimming gradation value of green, and the dimming gradation value of blue that have been acquired by the dimming gradation value acquisition processor 17. The highest value selector 18 performs the identification processing individually for each of the pixels 48 included in the display panel 30. Thereafter, the highest dimming gradation value identified for each pixel 48 by the highest value selector 18 is used as a candidate gradation value for each pixel 48.

The low resolution processor 19 adopts, as a dimming gradation value of one dimming pixel 148, a highest gradation value among the candidate gradation values of (for example, 3×3 of) the pixels 48 included in an area overlapping with the one dimming pixel 148 in the planar viewpoint. The low resolution processor 19 performs the adoption processing of such a gradation value individually for each of the dimming pixels 148 included in the dimming panel 80.

Figure 23:
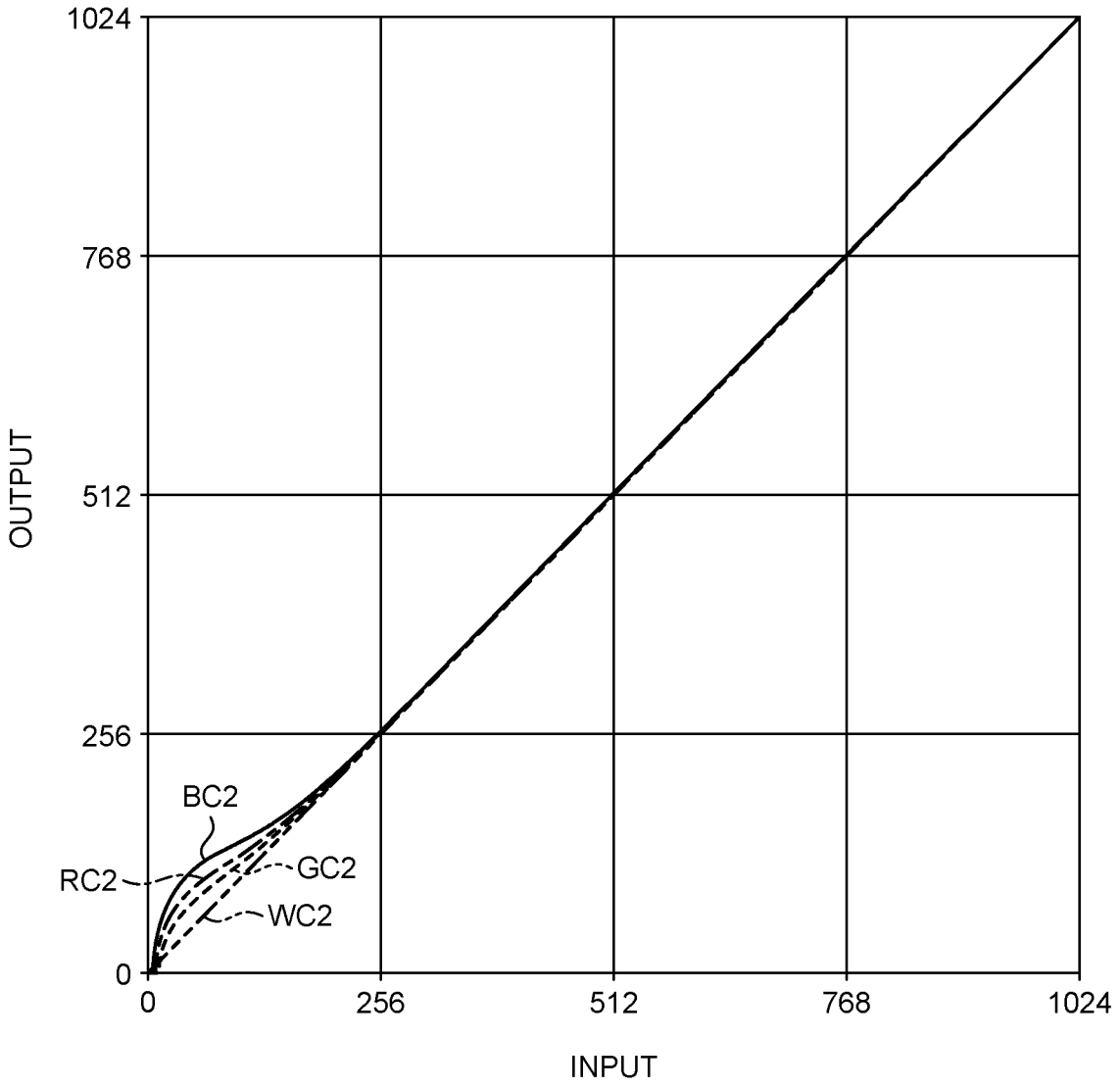
FIG. 23 is a graph illustrating an example of correspondence relations between a gradation value calculated by a gradation value determination processor and a color of a candidate gradation value as a source of a dimming gradation value of a dimming pixel in the third embodiment.
Figure 24:
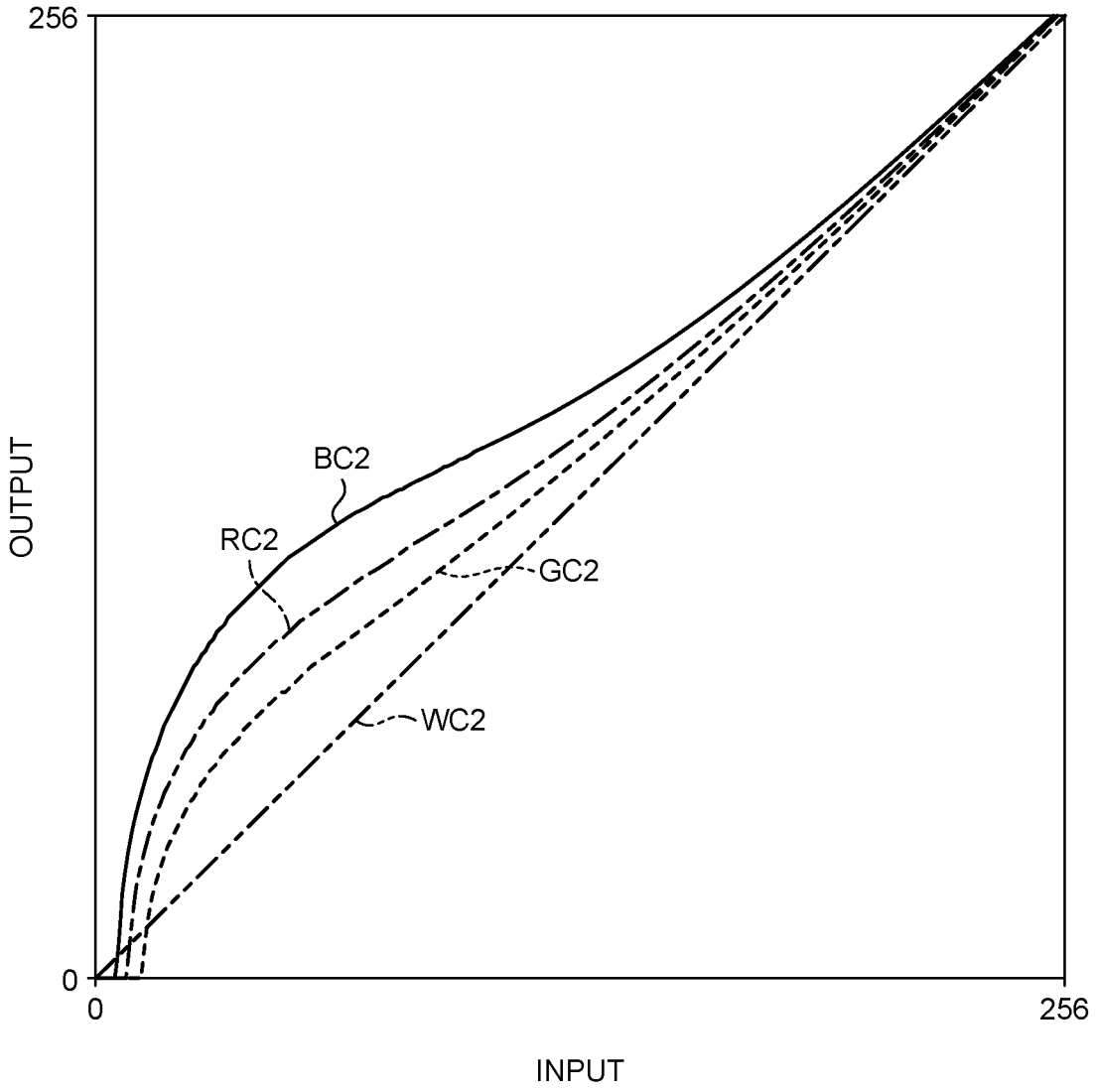
FIG. 24 is a view illustrating, in an enlarged manner, correspondence relations between input and output in a range of input and output gradation values from 0 to 256 in the graph illustrated in FIG. 23.

The gradation value determination processor 15 included in the signal processor 10B performs similar processing to that by the gradation value determination processor 15 included in the signal processor 10 in the first embodiment. Referring to FIG. 23 and FIG. 24, the following describes effects obtained by calculation, by the gradation value determination processor 15 in the third embodiment, of the gradation value (Rout) of the first sub pixel 49R, the gradation value (Gout) of the second sub pixel 49G, and the gradation value (Bout) of the third sub pixel 49B using Equation (1) to Equation (10) above and the fact that the above-mentioned candidate gradation value is any one of the dimming gradation value of white, the dimming gradation value of red, the dimming gradation value of green, and the dimming gradation value of blue. Specifically, since the gradation of the candidate gradation value on the low-gradation side is lower than the highest gradation value, processing in consideration of lowering in the luminance of light passing through the dimming panel 80 on the background side of the display panel 30 is performed when the display panel 30 performs output corresponding to a pixel signal of such a low gradation. More specifically, processing of increasing the gradation value contained in the low-gradation pixel signal is performed to compensate for lowering in the luminance of light.

FIG. 23 is a graph illustrating an example of correspondence relations between the gradation value calculated by the gradation value determination processor 15 and the color of the candidate gradation value as a source of the dimming gradation value of the dimming pixel 148 in the third embodiment. FIG. 24 is a view illustrating, in an enlarged manner, the correspondence relations between the input and the output in a range of input and output gradation values from 0 to 256 in the graph illustrated in FIG. 23. Hereinafter, an expression of calculation results of the gradation value determination processor 15 denotes the gradation value (Rout) of the first sub pixel 49R, the gradation value (Gout) of the second sub pixel 49G, and the gradation value (Bout) of the third sub pixel 49B calculated using Equation (1) to Equation (10) above by the gradation value determination processor 15 in the third embodiment.

Assume that, the dimming gradation value acquisition processor 17 sets the dimming gradation value of white as the candidate gradation value and the highest value selector 18 sets the candidate gradation value as the dimming gradation value (Wout) of the dimming pixel 148. In this case, the input-output relation of the gradation value determination processor 15 corresponding to the calculation result of the gradation value determination processor 15 is 1:1, as indicated by a graph WC2 illustrated in FIG. 23 and FIG. 24. As described with reference to FIG. 22, the input-output correspondence relation of the LUT that is referred to in the processing by the dimming gradation value acquisition processor 17 is different between white, red, green, and blue. The LUT is configured such that the higher dimming gradation value is more likely to be acquired in the order of white, green, red, and blue when the input gradation values thereof are the same. In particular, as illustrated in FIG. 22, the tendency that the output of white is higher than the outputs of the other colors (red, green, and blue) is more significant in a range where the inputs of the dimming gradation value acquisition processor 17 are equal to or lower than 256 in 10-bit values, that is, in a range where the inputs of the dimming gradation value acquisition processor 17 are relatively low gradation values in the entire 10-bit values. In other words, when the dimming gradation value acquisition processor 17 sets the dimming gradation value of white as the candidate gradation value and the highest value selector 18 sets the candidate gradation value as the dimming gradation value (Wout) of the dimming pixel 148, a division value (Wout'=(Wout/Max)^2.2) in the gradation value in accordance with Equation (1) to Equation (10) above is more likely to be close to 1 than that when any of the dimming gradation values of the other colors is set as the candidate gradation value. Thus, when the dimming gradation value acquisition processor 17 sets the dimming gradation value of white as the candidate gradation value and the highest value selector 18 sets the candidate gradation value as the dimming gradation value (Wout) of the dimming pixel 148, values (Rin and Rout, Gin and Gout, and Bin and Bout) before and after the calculation using Equation (1) to Equation (10) tend to be closer to each other than those when any of the dimming gradation values of the other colors is set as the candidate gradation value.

As a precondition, it is assumed that the gradation values of red (R), green (G), and blue (B) indicated by the input signal are the same. In this case, the LUT is configured such that the higher dimming gradation value is more likely to be acquired in the order of white, green, red, and blue. In this case, it is assumed that the dimming gradation value acquisition processor 17 sets the dimming gradation value of blue as the candidate gradation value and the highest value selector 18 sets the candidate gradation value as the dimming gradation value (Wout) of the dimming pixel 148. In this case, the division value (Wout/MAX) is therefore more unlikely to be close to 1 than that when any of the dimming gradation values of the other colors is set as the candidate gradation value. With a similar concept, on the same precondition as described above, it is assumed that the dimming gradation value acquisition processor 17 sets the dimming gradation value of green as the candidate gradation value and the highest value selector 18 sets the candidate gradation value as the dimming gradation value (Wout) of the dimming pixel 148. In this case, the division value Wout' is more unlikely to be close to 1 than that when the dimming gradation value of white is set as the candidate gradation value.

Furthermore, on the same precondition as described above, it is assumed that the dimming gradation value acquisition processor 17 sets the dimming gradation value of red as the candidate gradation value and the highest value selector 18 sets the candidate gradation value as the dimming gradation value (Wout) of the dimming pixel 148. In this case, the division value Wout' is more unlikely to be close to 1 than that when the dimming gradation value of white or green is set as the candidate gradation value.

The larger difference between the values (Rin and Rout, Gin and Gout, Bin and Bout) before and after the calculation using Equation (1) to Equation (10) is expressed as a larger rise of the gradation value. Based on the above-mentioned relations between the candidate gradation value and the color, when the dimming gradation value acquisition processor 17 sets the dimming gradation value of blue as the candidate gradation value and the highest value selector 18 sets the candidate gradation value as the dimming gradation value (Wout) of the dimming pixel 148, the rise of the gradation value indicated by the calculation result of the gradation value determination processor 15 is likely to be larger than that when the dimming gradation value acquisition processor 17 sets any of the dimming gradation values of the other colors as the candidate gradation value, as indicated by the difference between a graph BC2 and the graph WC2 in FIG. 23. In particular, the tendency is more significant in the range where the RGB gradation values indicated by the pixel signal of the input signal IP input to the gradation value determination processor 15 are relatively low gradation values in the entire 10-bit values, as indicated by the difference between the graph BC2 and the graph WC2 in FIG. 24. This is because as illustrated in FIG. 22, the difference between the output of blue and the outputs of the other colors (especially white) is more significant in the range where the inputs of the dimming gradation value acquisition processor 17 are relatively low gradation values in the entire 10-bit values.

With a similar concept, based on the above-mentioned relations between the candidate gradation value and the color, when the dimming gradation value acquisition processor 17 sets the dimming gradation value of red as the candidate gradation value and the highest value selector 18 sets the candidate gradation value as the dimming gradation value (Wout) of the dimming pixel 148, the rise of the gradation value indicated by the calculation result of the gradation value determination processor 15 is likely to be larger than that when the dimming gradation value acquisition processor 17 sets the dimming gradation value of white or green as the candidate gradation value, as indicated by the difference between a graph RC2 and the graph WC2 in FIG. 23. Based on the above-mentioned relations between the candidate gradation value and the color, when the dimming gradation value acquisition processor 17 sets the dimming gradation value of green as the candidate gradation value and the highest value selector 18 sets the candidate gradation value as the dimming gradation value (Wout) of the dimming pixel 148, the rise of the gradation value indicated by the calculation result of the gradation value determination processor 15 is likely to be larger than that when the dimming gradation value acquisition processor 17 sets the dimming gradation value of white as the candidate gradation value, as indicated by the difference between a graph GC2 and the graph WC2 in FIG. 23. Also in the cases of red and green, the tendency is more significant in the range where the RGB gradation values indicated by the pixel signal of the input signal IP input to the gradation value determination processor 15 are relatively low gradation values in the entire 10-bit values, as indicated by the difference between the graph RC2 and the graph GC2 and the graph WC2 in FIG. 24.

Regardless of the color of the dimming value to which the candidate gradation value is set, the rise of the gradation value does not occur within the range where the dimming gradation value (Wout) of the dimming pixel 148 is saturated with the highest value (MAX).

The color reproducibility becomes more preferable by taking into consideration the relation between the color of the candidate gradation value as the source of the dimming gradation value (Wout) of the dimming pixel 148 and the rise of the gradation value in the third embodiment. This is explained with reference to FIG. 25 to FIG. 27.

Figure 25:
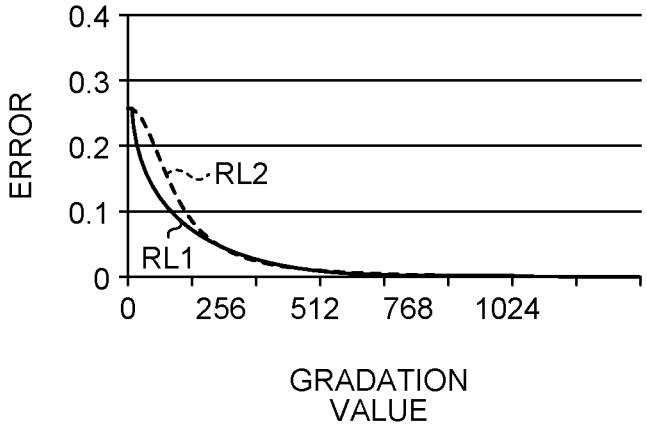
FIG. 25 is a graph illustrating a relation between the level of a gradation value of red and an error between a reproduced color and a correct color.
Figure 26:
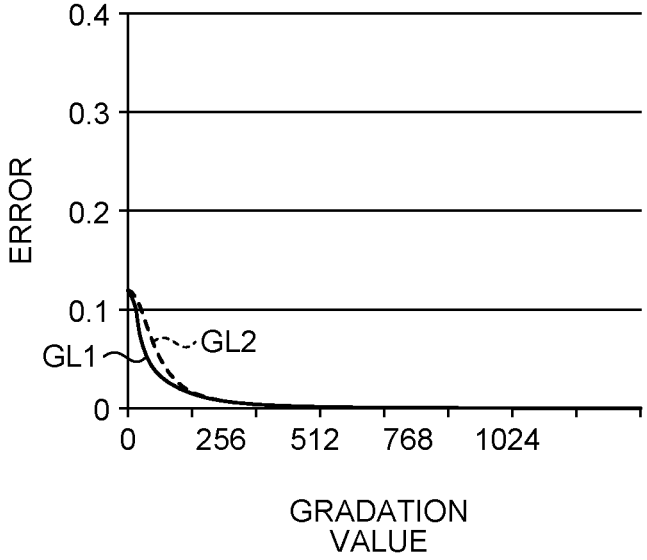
FIG. 26 is a graph illustrating a relation between the level of a gradation value of green and an error between a reproduced color and a correct color.
Figure 27:
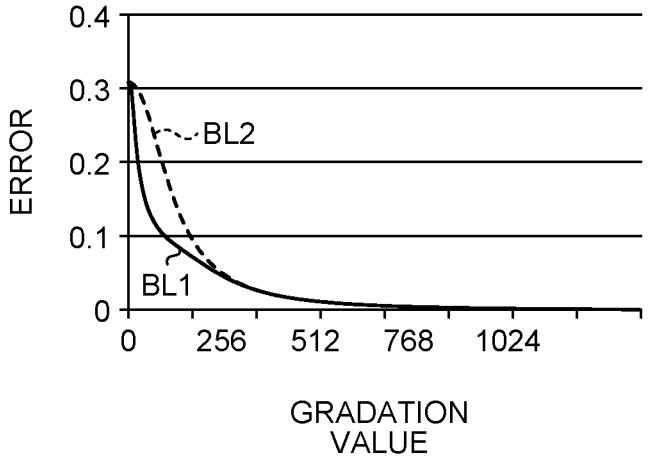
FIG. 27 is a graph illustrating a relation between the level of a gradation value of blue and an error between a reproduced color and a correct color.

FIG. 25 is a graph illustrating a relation between the level of the gradation value of red and an error between a reproduced color and a correct color. FIG. 26 is a graph illustrating a relation between the level of the gradation value of green and an error between a reproduced color and a correct color. FIG. 27 is a graph illustrating a relation between the level of the gradation value of blue and an error between a reproduced color and a correct color.

It is assumed that the candidate gradation value is limited to the dimming gradation value of white (graph WC1 illustrated in FIG. 22) and the dimming gradation values of the other colors are not adopted. Under this assumption, the error between the reproduced color that is viewed by the user in the display output of the display device 1 and the correct color is as indicated by a graph RL2 illustrated in FIG. 25 for red, as indicated by a graph GL2 illustrated in FIG. 26 for green, and as indicated by a graph BL2 illustrated in FIG. 27 for blue.

In contrast, in the embodiment, the candidate gradation value is not limited to the dimming gradation value of white (graph WC1 illustrated in FIG. 22). Thus, when, for example, the primary color of red is output for full screen display, the candidate gradation value is the gradation value of red (graph RC1 illustrated in FIG. 22). That is to say, in the above-mentioned range of the relatively low-gradation values, the degree at which the dimming pixels 148 transmit light is lowered and the luminance of light illuminating the pixels 48 is lowered. That is to say, the above-mentioned numerical value of α% decreases (refer to FIG. 20). Thus, the luminance of light of α×min % that is viewed through the sub pixels (the second sub pixel 49G and the third sub pixel 49B) other than that of red is further lowered. On the other hand, the luminance of red is ensured by the above-mentioned rise of the gradation value. The third embodiment can therefore prevent increase in the error where the primary color of red is separated from the correct color due to mixing of green and blue. In FIG. 25, a graph RL1 indicates the error between the reproduced color of red that is viewed by the user in the display output of the display device 1 in the third embodiment and the correct color, and indicates that the error therebetween is smaller than the error indicated by the graph RL2 under the above-mentioned assumption.

Although the above-mentioned example has explained the case where the primary color of red is output for full screen display, the same applies to the colors (green and blue) other than red. That is to say, the third embodiment can prevent increase in the error where the reproduced color is farther away from the correct color of the primary color due to mixing of the other colors into the primary color. In FIG. 26, a graph GL1 indicates the error between the reproduced color of green that is viewed by the user in the display output of the display device 1 in the third embodiment and the correct color, and indicates that the error therebetween is smaller than the error indicated by the graph GL2 under the above-mentioned assumption. In FIG. 27, a graph BL1 indicates the error between the reproduced color of blue that is viewed by the user in the display output of the display device 1 in the third embodiment and the correct color is indicated by, and indicates that the error therebetween is smaller than the error indicated by the graph BL2 under the above-mentioned assumption.

In the above description with reference to FIG. 22, the different input-output correspondence relations are employed for white, red, green, and blue. The LUT that can be referred to by the dimming gradation value acquisition processor 17 in the third embodiment is, however, not limited thereto. The following describes a case where another LUT is referred to, with reference to FIG. 28 and FIG. 29.

Figure 28:
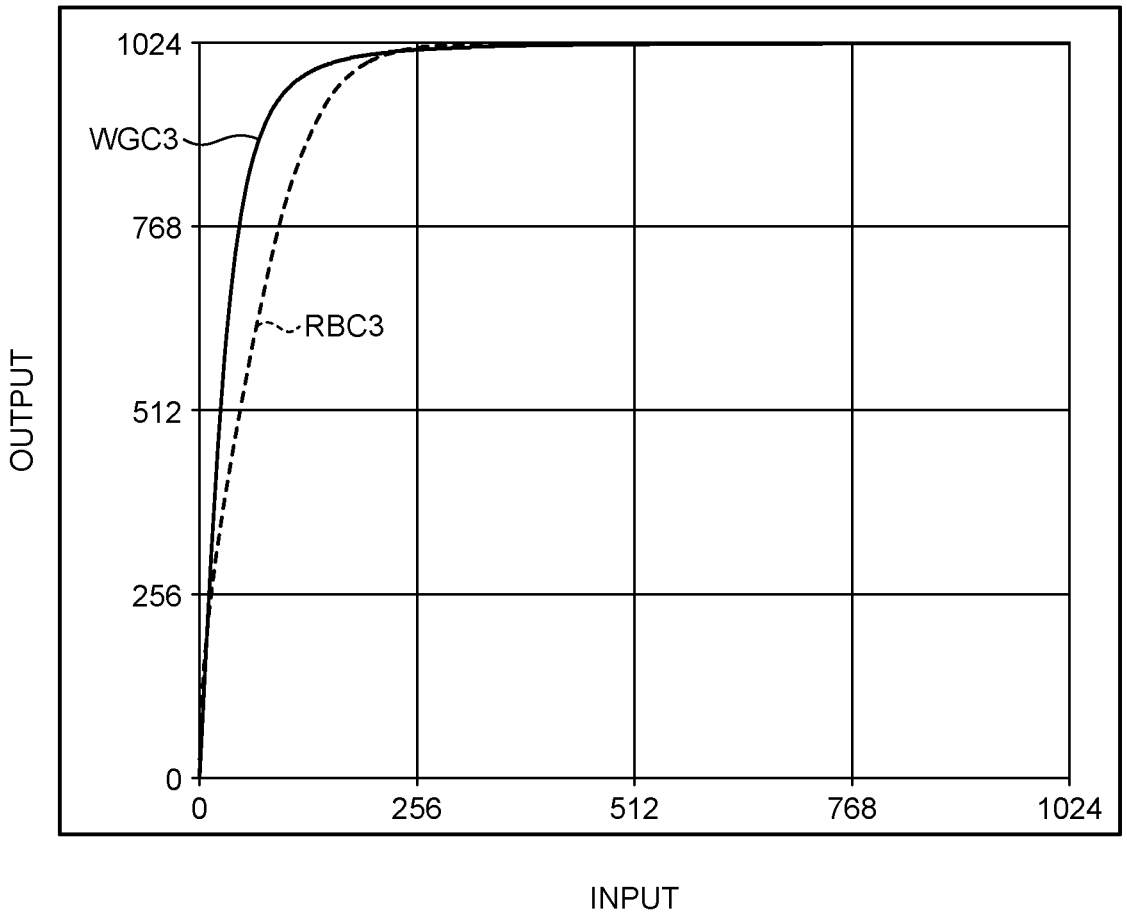
FIG. 28 is a graph illustrating another example of the correspondence relations between the input and the output of the dimming gradation value acquisition processor.

FIG. 28 is a graph illustrating another example of the correspondence relations between the input and the output of the dimming gradation value acquisition processor 17. When the LUT corresponding to the input and the output illustrated in FIG. 28 is employed, the dimming gradation value acquisition processor 17 acquires the dimming gradation value of white from the gradation value (Wa) that can be handled as the white component derived by the white component extraction processor 16, in accordance with the input-output correspondence relation indicated by a graph WGC3. The dimming gradation value acquisition processor 17 acquires the dimming gradation value of red from the gradation value (Ra) of red that is included in the RGB gradation values from which the white component has been derived in accordance with the input-output correspondence relation indicated by a graph RBC3. The dimming gradation value acquisition processor 17 acquires the dimming gradation value of green from the gradation value (Ga) of green that is included in the RGB gradation values, in accordance with the input-output correspondence relation indicated by the graph WGC3. The dimming gradation value acquisition processor 17 acquires the dimming gradation value of blue from the gradation value (Ba) of blue that is included in the RGB gradation values, in accordance with the input-output correspondence relation indicated by the graph RBC3. As described above, when the LUT corresponding to the input and the output illustrated in FIG. 28 is employed, the input-output relation when the input is the gradation value (Wa) of white and the input-output relation when the input is the gradation value of green (Ga) are common as indicated by the graph WGC3. The input-output relation when the input is the gradation value (Ra) of red and the input-output relation when the input is the gradation value of blue (Ba) are common as indicated by the graph RBC3. In this manner, some of the colors can be made to have the common input-output relation. With the LUT, higher dimming gradation values are likely to be acquired for white and green than for red and blue when the input gradation values thereof are the same.

Figure 29:
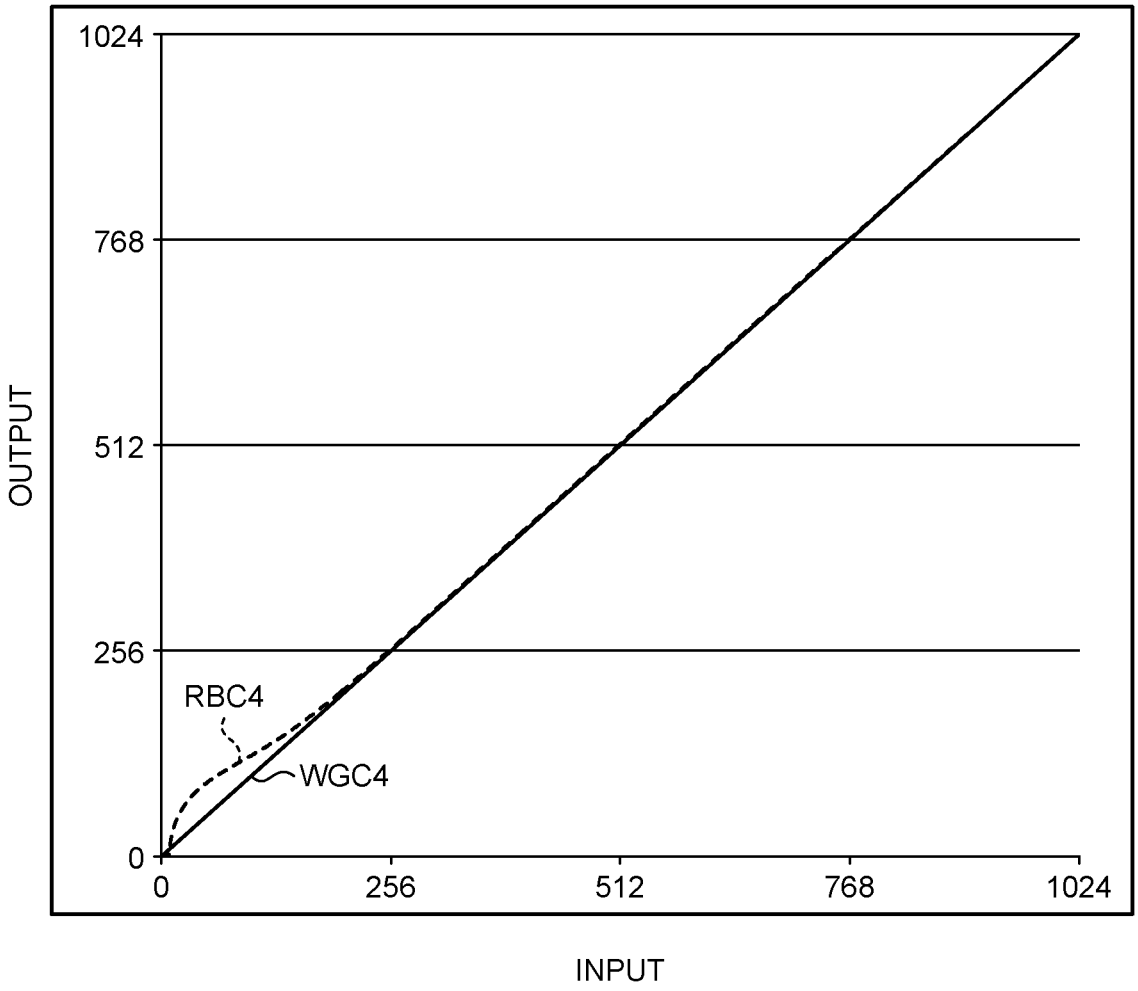
FIG. 29 is a graph illustrating another example of the correspondence relations between the gradation value calculated by the gradation value determination processor and the color of the candidate gradation value as the source of the dimming gradation value of the dimming pixel in the third embodiment.

FIG. 29 is a graph illustrating another example of the correspondence relations between the gradation value calculated by the gradation value determination processor 15 and the color of the candidate gradation value as the source of the dimming gradation value of the dimming pixel 148 in the third embodiment. In the example illustrated in FIG. 28, when the dimming gradation value acquisition processor 17 sets the dimming gradation value of white or green as the candidate gradation value and the highest value selector 18 sets the candidate gradation value as the dimming gradation value (Wout) of the dimming pixel 148, the input-output relation of the gradation value determination processor 15 corresponding to the calculation result of the gradation value determination processor 15 is assumed to be 1:1 as indicated by a graph WGC4 illustrated in FIG. 29.

As indicated by difference between a graph RBC4 and the graph WGC4 in FIG. 29, when the dimming gradation value acquisition processor 17 sets the dimming gradation value of red or blue as the candidate gradation value and the highest value selector 18 sets the candidate gradation value as the dimming gradation value (Wout) of the dimming pixel 148, the rise of the gradation value indicated by the calculation result of the gradation value determination processor 15 is likely to be larger than that when the dimming gradation value acquisition processor 17 sets the dimming gradation value of white or green as the candidate gradation value. In particular, the tendency is more significant in the range where the RGB gradation values indicated by the pixel signal of the input signal IP input to the gradation value determination processor 15 are relatively low gradation values in the entire 10-bit values.

As described above, the third embodiment is similar to the first embodiment except for the specially mentioned matters.

Fourth Embodiment

Hereinafter, a fourth embodiment that differs from the third embodiment in some processing is explained. In explanation of the fourth embodiment, the same reference numerals denote similar components to those in the third embodiment, and explanation thereof may be omitted.

Figure 30:
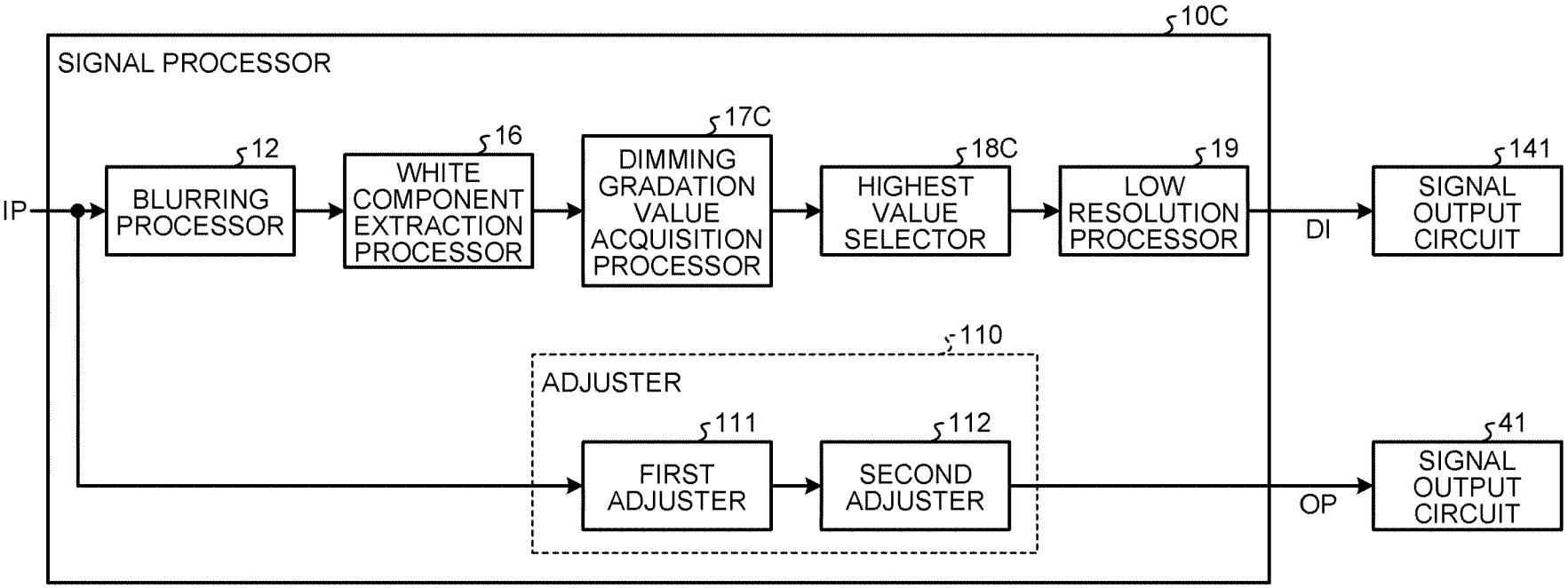
FIG. 30 is a block diagram illustrating a functional configuration of a signal processor and input and output of the signal processor according to a fourth embodiment.

FIG. 30 is a block diagram illustrating a functional configuration of a signal processor 10C and input and output of the signal processor 10C according to the fourth embodiment. In the fourth embodiment, the signal processor 10C illustrated in FIG. 30 is employed in place of the signal processor 10 in the first embodiment.

A dimming gradation value acquisition processor 17C of the signal processor 10C is functionally similar to the dimming gradation value acquisition processor 17 in the third embodiment. The dimming gradation value acquisition processor 17C performs input and output explained with reference to FIG. 28. A highest value selector 18C of the signal processor 10C is functionally similar to the highest value selector 18 in the third embodiment. The highest value selector 18C performs processing of identifying a highest dimming gradation value among dimming gradation values of a plurality of colors that have been acquired by the dimming gradation value acquisition processor 17C. The highest value selector 18C performs the identification processing individually for each of the pixels 48 included in the display panel 30. In the signal processor 10C, the gradation value determination processor 15 provided in the signal processor 10B is omitted. On the other hand, the signal processor 10C includes an adjuster 110. Except for the above matters, the signal processor 10C is similar to the signal processor 10B.

The adjuster 110 performs a plurality of pieces of processing for adjusting pixel signals of the input signal IP to generate pixel signals of the output image signal OP. The adjuster 110 includes a first adjuster 111 and a second adjuster 112, as illustrated in FIG. 30.

The first adjuster 111 adjusts gradation values of predetermined primary colors. Each of the predetermined primary colors is a primary color for which an input-output relation differing from an input-output relation in a LUT that is referred to in acquisition of the dimming gradation value of white by the dimming gradation value acquisition processor 17C is defined in the LUT. In the case of the example illustrated in FIG. 28, the graph WGC3 indicates the input-output relation in the LUT that is referred to in acquisition of the dimming gradation value of white. The graph WGC3 is applied to white and green. Thus, in the case of the example illustrated in FIG. 28, the colors for which the input-output relation differing from the input-output relation in the LUT that is referred to in acquisition of the light gradation value of white by the dimming gradation value acquisition processor 17C is defined in the LUT, are red and blue.

Specifically, the first adjuster 111 performs processing of adjusting and outputting the gradation value of red (R) and the gradation value of blue (B) among input RGB gradation values so as to establish the input-output correspondence relation indicated by the graph RBC4 in FIG. 29. The first adjuster 111 performs the processing for each of the pixel signals contained in the input signal IP. Output of the first adjuster 111 is made to the second adjuster 112.

Figure 31:
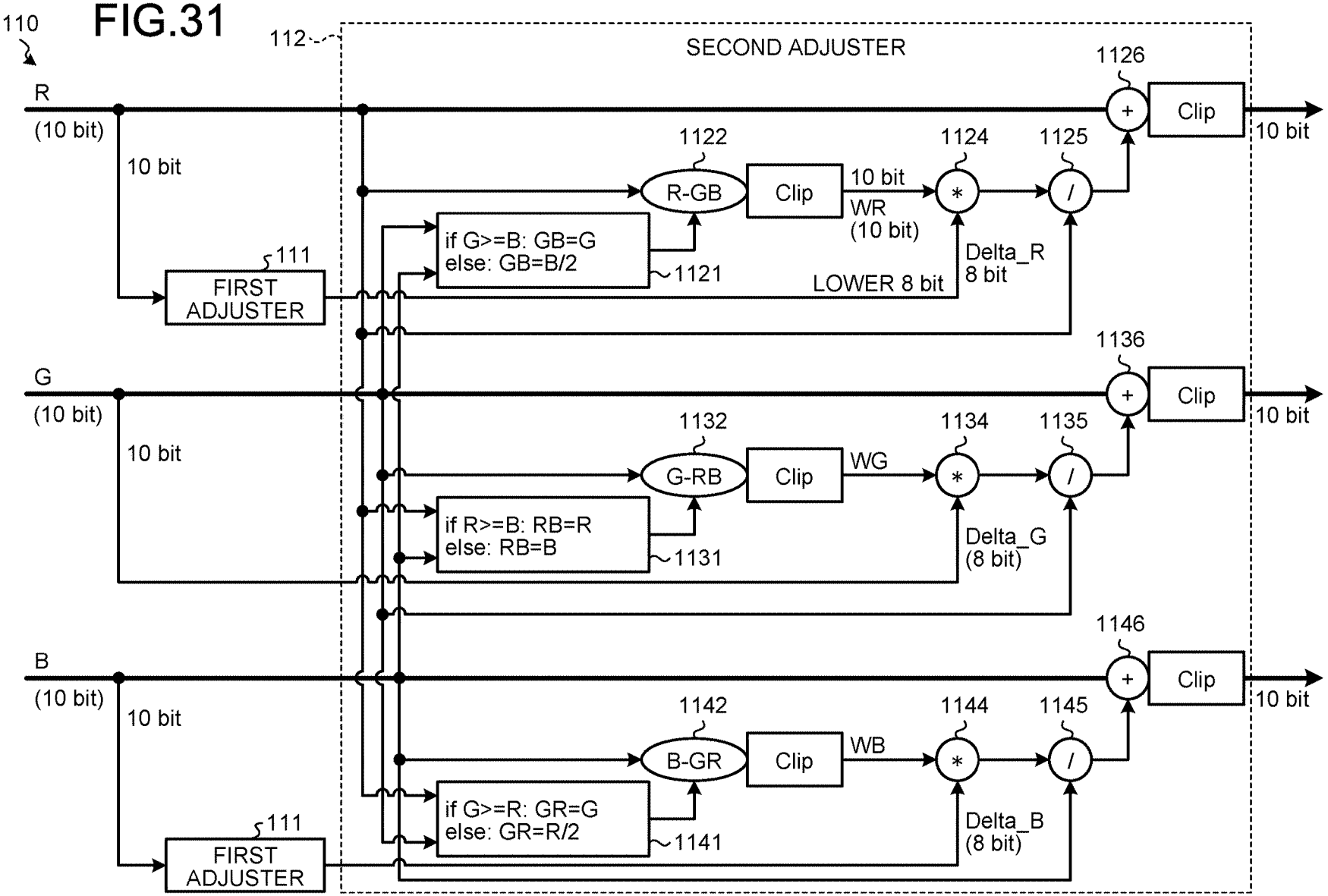
FIG. 31 is a diagram illustrating a more detailed functional configuration of an adjuster.

FIG. 31 is a diagram illustrating a more detailed functional configuration of the adjuster 110. As illustrated in FIG. 31, as for the gradation value of red (R) and the gradation value of blue (B) among the RGB gradation values indicated by the pixel signal of the input signal IP input to the adjuster 110, both the gradation values adjusted by the first adjuster 111 and the gradation values not adjusted by the first adjuster 111 are input to the second adjuster 112.

The second adjuster 112 performs a plurality of pieces of processing related to adjustment of the gradation values. The second adjuster 112 includes an arithmetic unit 1121, an arithmetic unit 1122, an arithmetic unit 1124, an arithmetic unit 1125, an arithmetic unit 1126, an arithmetic unit 1131, an arithmetic unit 1132, an arithmetic unit 1134, an arithmetic unit 1135, an arithmetic unit 1136, an arithmetic unit 1141, an arithmetic unit 1142, an arithmetic unit 1144, an arithmetic unit 1145, and an arithmetic unit 1146.

An expression of one pixel signal denotes one of the pixel signals contained in the input signal IP, which is assigned to one certain pixel 48. In the fourth embodiment, the gradation value of red (R), the gradation value of green (G), and the gradation value of blue (B) that are indicated by the pixel signal are assumed to be represented as 10-bit numerical values.

First, processing related to the gradation value of red (R) among the pieces of processing by the second adjuster 112 is explained. The arithmetic unit 1121 determines a value of an argument GB based on the gradation value of green (G) and the gradation value of blue (B) indicated by one pixel signal. Specifically, when the gradation value of green (G) is equal to or higher than the gradation value of blue (B), the arithmetic unit 1121 sets the argument GB to the same value as the gradation value of green (G). On the other hand, when the gradation value of green (G) is lower than the gradation value of blue (B), the arithmetic unit 1121 sets a value obtained by halving the gradation value of blue (B) as the value of the argument GB. The arithmetic unit 1122 calculates a value obtained by subtracting the argument GB from the gradation value of red (R) indicated by the one pixel signal. The value calculated by the arithmetic unit 1122 is handled as a value of an argument WR. The arithmetic unit 1124 calculates a multiplication value (WR*Delta_R) of the argument WR and a value (Delta_R) of the lower 8 bits of the gradation value of red (R) that has been adjusted by the first adjuster 111. The arithmetic unit 1125 calculates a value obtained by dividing the multiplication value (WR*Delta_R) calculated by the arithmetic unit 1124 by the gradation value of red (R) indicated by the one pixel signal. The arithmetic unit 1126 outputs a value obtained by adding together the gradation value of red (R) indicated by the one pixel signal and the value calculated by the arithmetic unit 1125. The value output by the arithmetic unit 1126 is handled as the gradation value of red (R) indicated by the pixel signal of the output image signal OP. The pixel signal of the output image signal OP is assigned to the pixel 48 to which the one pixel signal is assigned.

Next, the following describes processing related to the gradation value of green (G) among the pieces of processing by the second adjuster 112. The arithmetic unit 1131 determines a value of an argument RB based on the gradation value of red (R) and the gradation value of blue (B) indicated by the one pixel signal. Specifically, when the gradation value of red (R) is equal to or higher than the gradation value of blue (B), the arithmetic unit 1121 sets the argument RB to the same value as the gradation value of red (R). On the other hand, when the gradation value of red (R) is lower than the gradation value of blue (B), the arithmetic unit 1121 sets the argument RB to the same value as the gradation value of blue (B). The arithmetic unit 1132 calculates a value obtained by subtracting the argument RB from the gradation value of green (G) indicated by the one pixel signal. The value calculated by the arithmetic unit 1132 is handled as a value of an argument WG. The arithmetic unit 1134 calculates a multiplication value (WG*Delta_G) of the argument WG and a value (Delta_G) of the lower 8 bits of the gradation value of green (G) indicated by the one pixel signal. The arithmetic unit 1135 calculates a value obtained by dividing the multiplication value (WG*Delta_G) calculated by the arithmetic unit 1134 by the gradation value of green (G) indicated by the one pixel signal. The arithmetic unit 1136 outputs a value obtained by adding together the gradation value of green (R) indicated by the one pixel signal and the value calculated by the arithmetic unit 1135. The value output by the arithmetic unit 1136 is handled as the gradation value of green (GG) indicated by the pixel signal of the output image signal OP. The pixel signal of the output image signal OP is assigned to the pixel 48 to which the one pixel signal is assigned.

Next, the following describes processing related to the gradation value of blue (B) among the pieces of processing by the second adjuster 112. The arithmetic unit 1141 determines a value of an argument RG based on the gradation value of red (R) and the gradation value of green (G) indicated by the one pixel signal. Specifically, when the gradation value of green (G) is equal to or higher than the gradation value of red (R), the arithmetic unit 1141 sets the argument RG to the same value as the gradation value of green (G). On the other hand, when the gradation value of green (G) is lower than the gradation value of red (R), the arithmetic unit 1141 sets a value obtained by halving the gradation value of red (R) as the value of the argument RG. The arithmetic unit 1142 calculates a value obtained by subtracting the argument RG from the gradation value of blue (B) indicated by the one pixel signal. The value calculated by the arithmetic unit 1142 is handled as a value of an argument WB. The arithmetic unit 1144 calculates a multiplication value (WR*Delta_B) of the argument WB and a value (Delta_B) of the lower 8 bits of the gradation value of blue (B) that has been adjusted by the first adjuster 111. The arithmetic unit 1145 calculates a value obtained by dividing the multiplication value (WB*Delta_B) calculated by the arithmetic unit 1144 by the gradation value of blue (B) indicated by the one pixel signal. The arithmetic unit 1146 outputs a value obtained by adding together the gradation value of blue (B) indicated by the one pixel signal and the value calculated by the arithmetic unit 1145. The value output by the arithmetic unit 1146 is handled as the gradation value of blue (B) indicated by the pixel signal of the output image signal OP. The pixel signal of the output image signal OP is assigned to the pixel 48 to which the one pixel signal is assigned.

The second adjuster 112 performs the above-mentioned pieces of processing for the gradation value of red (R), the gradation value of green (G), and the gradation value of blue (B) individually for each of the pixel signals contained in the input signal IP, and outputs the output image signal OP containing the pixel signals.

As described above, the gradation value determination processor 15 is omitted in the fourth embodiment. For this reason, although the luminance of light emitted from the light source device 50 through the dimming pixels 148 to the pixels 48 differs between the case where the gradation value of white or green is adopted and the case where the dimming gradation value of red or blue is adopted in adoption of the candidate gradation value by the dimming gradation value acquisition processor 17C, the gradation values of the input signal IP are not adjusted for the difference between the cases. The adjustment by the adjuster 110 copes with the difference between the cases in the fourth embodiment. Specifically, the first adjuster 111 performs the processing of adjusting the gradation value of red (R) and the gradation value of blue (B) to ensure reproducibility of red and blue when the dimming gradation value of red or blue is adopted in the adoption of the candidate gradation value by the dimming gradation value acquisition processor 17C. If it is assumed that only the processing by the first adjuster 111 is performed, only the gradation value of red (R) and gradation value of blue (B) are adjusted even when the gradation value of white or green is adopted in the adoption of the candidate gradation value by the dimming gradation value acquisition processor 17C, which affects the reproducibility of white. To cope with this, the processing by the second adjuster 112 restrains the processing by the first adjuster 111 from affecting the reproducibility of white.

Reproduction of white means that the gradation value of red (R), the gradation value of green (G), and the gradation value of blue (B) are the same value (E) like (R, G, B)=(E, E, E) in the gradation values indicated by the pixel signal of the input signal IP. In this case, the arithmetic unit 1121 sets the argument GB to be the same value (E) as the gradation value of green (G). The arithmetic unit 1122 calculates the value of the argument WR by subtracting the argument GB from the gradation value of red (R). Since the gradation value of red (R) and the value of the argument GB are the same value (E), the argument WR is 0. Thus, the value (WR*Delta_R/R) that is added to the gradation value of red (R) by the arithmetic unit 1126 is 0 because the value of the argument WR multiplied in the numerator is 0. That is to say, the value that is output after the processing by the arithmetic unit 1126 is the gradation value (E) of red (R). As described above, the processing by the second adjuster 112 restrains the adjustment by the first adjuster 111 from affecting the reproduction of white. Similarly, when white is reproduced, the argument WG that is calculated by the arithmetic unit 1132 is 0. When white is reproduced, the argument WB that is calculated by the arithmetic unit 1142 is 0. Thus, when white is reproduced, the pixel signal of the input signal IP is reflected to the output image signal OP without being adjusted, and the processing by the first adjuster 111 does not affect the reproducibility of white.

The functions of the dimming gradation value acquisition processor 17C are not limited to those of performing the input and the output explained with reference to FIG. 28. For example, the dimming gradation value acquisition processor 17C may perform the input and the output explained with reference to FIG. 22. That is to say, the individual input-output relations (the graph WC1, the graph RC1, the graph GC1, and the graph BC1) for white, red, green, and blue may be applied. In such a case, the first adjuster 111 performs processing of adjusting and outputting the gradation value of green (G) among the input RGB gradation values so as to establish the input-output correspondence relation indicated by the graph GC2 in FIG. 23 and FIG. 24. The first adjuster 111 performs the processing for each of the pixel signals contained in the input signal IP. In this case, the arithmetic unit 1134 calculates a multiplication value (WG*Delta_G) of the argument WG and the value (Delta_G) of the lower 8 bits of the gradation value of green (G) that has been adjusted by the first adjuster 111. The input-output relations corresponding to the pieces of processing in which the first adjuster 111 adjusts the gradation value of red (R) and the gradation value of blue (B) correspond to the graph RC2 and the graph BC2, respectively, in the above-mentioned case.

A combination of the targets to be adjusted by the first adjuster 111 is not limited to red (R) and blue (B) or red (R), green (G) and blue (B). The target of the processing by the first adjuster 111 is the color for which another reference data establishing a different input-output relation from first reference data (the graph WC1 or the graph WGC3) is used for determining the dimming gradation value. The first reference data is used when the gradation value (Wa) capable of being extracted as white is adopted as the highest gradation value after the blurring processing. It is therefore sufficient that the target of adjustment by the first adjuster 111 is at least equal to or more than one color of red (R), green (G), and blue (B).

As described above, the display device 1 includes the first liquid crystal panel (dimming panel 80), the second liquid crystal panel (display panel 30) arranged on one surface side of the first liquid crystal panel so as to face the first liquid crystal panel, the light source (light source device 50) configured to emit light from the other surface side of the first liquid crystal panel, and the controller (signal processor 10) configured to control the first liquid crystal panel and the second liquid crystal panel on the basis of an image signal corresponding to the resolution of the second liquid crystal panel. The first liquid crystal panel includes the dimming pixels (dimming pixels 148). The second liquid crystal panel includes the pixels 48. More than one of the pixels 48 is arranged within the region of one of the dimming pixels. The controller performs the blurring processing and the determination of the dimming gradation value as processing related to operation of the second liquid crystal panel. In the blurring processing, on the basis of the gradation values indicated by the pixel signal contained in the image signal, lower gradation values are set for pixels 48 (second pixels) farther from a pixel 48 (first pixel) that is given the pixel signal, the second pixels 48 being arranged within the predetermined region around the first pixel 48 that is given the pixel signal. Each of the dimming gradation values corresponds to the highest gradation value set after the blurring processing among the gradation values set for the more than one pixel 48 arranged within the region of each of the dimming pixels. The degree of light transmission through the dimming pixel is controlled in accordance with the dimming gradation value.

This configuration reduces occurrence of such a phenomenon that the position of the pixel 48 transmitting light cannot be reflected when setting the dimming gradation value as described above with reference to FIG. 12. As a result, it is possible to provide the display device 1 capable of controlling light so as to provide light corresponding to an image to be output more preferably.

The first liquid crystal panel (dimming panel 80) is a monochrome liquid crystal panel. The second liquid crystal panel (display panel 30) is a color liquid crystal panel in which each of the pixels 48 includes the first sub pixel 49R, the second sub pixel 49G, and the third sub pixel 49B. The first sub pixel 49R is provided so as to be able to transmit red light. The second sub pixel 49G is provided so as to be able to transmit green light. The third sub pixel is provided so as to be able to transmit blue light. With this configuration, the display device 1 capable of outputting images in color can control light so as to provide light corresponding to the image to be output more preferably.

As in the second embodiment, the image signal (input signal IP) is input to the second liquid crystal panel (display panel 30) as the output image signal OP without being processed by the signal processor 10. With this operation, the processing related to operation control of the second liquid crystal panel can be further simplified. Image quality in the oblique viewpoint can be made preferable more easily as described with reference to FIG. 18 and FIG. 19.

As in the third embodiment, the controller (signal processor 10) determines the dimming gradation value by using the reference data (LUT) of the correspondence relation between the above-mentioned highest gradation value as the input value and the dimming gradation value as the output value. The reference data (graph RC1) when the gradation value set for the first sub pixel 49R is adopted as the highest gradation value after the blurring processing, the reference data (graph GC1) when the gradation value set for the second sub pixel 49G is adopted as the highest gradation value after the blurring processing, the reference data (graph BC1) when the gradation value set for the third sub pixel 49B is adopted as the highest gradation value after the blurring processing, and the reference data (graph WC1) when the lowest gradation value (Wa) among the gradation value set for the first sub pixel 49R, the gradation value set for the second sub pixel 49G, and the gradation value set for the third sub pixel 49B is adopted as the highest gradation value after the blurring processing are different from each other. The color reproducibility in the display output can thereby be further enhanced.

The image signal (input signal IP) is input to the second liquid crystal panel (display panel 30) as the output image signal OP without being processed by the signal processor 10. The controller (signal processor 10) determines the dimming gradation value by using the reference data (LUT) of the correspondence relation between the highest gradation value as the input value and the dimming gradation value as the output value. The second reference data (for example, the graph RBC3) differing from the first reference data (for example, the graph WGC3) is used in at least one of a first case, a second case, and a third case. The first reference data is used when the lowest gradation value (Wa) among the gradation value set for the first sub pixel 49R, the gradation value set for the second sub pixel 49G, and the gradation value set for the third sub pixel 49B is adopted as the highest gradation value after the blurring processing. This first case is when the gradation value set for the first sub pixel 49R is adopted as the highest gradation value after the blurring processing. This second case is when the gradation value set for the second sub pixel 49G is adopted as the highest gradation value after the blurring processing. This third case is when the gradation value set for the third sub pixel 49B is adopted as the highest gradation value after the blurring processing. The second reference data includes partial data establishing a correspondence relation between the highest gradation value and the dimming gradation value, the dimming gradation value being determined to be lower in the partial data than in the first reference data. The controller controls the adjuster 110 to perform first adjustment of further increasing the gradation value of the pixel signal when the gradation value equal to or lower than the highest gradation value contained in the partial data is given to the pixel 48 by the pixel signal. When the second reference data is used in the first case, the gradation value of the first sub pixel 49R is a target of the first adjustment. When the second reference data is used in the second case, the gradation value of the second sub pixel 49G is the target of the first adjustment. When the second reference data is used in the third case, the gradation value of the third sub pixel 49B is the target of the first adjustment. This configuration makes it easier to achieve both simplification of the processing related to the operation control of the second liquid crystal panel and reproducibility of the colors in the display output.

When the first reference data (for example, the graph WGC3) is used, the controller (signal processor 10) performs second adjustment, by the second adjuster 112, of canceling the first adjustment by the first adjuster 111. The color reproducibility in the display output can thereby be further enhanced.

Each of the signal processors 10, 10A, 10B, and 10C may be provided as one circuit, or the functions of each of the signal processors 10, 10A, 10B, and 10C may be implemented by a combination of a plurality of circuits.

Other action effects provided by the modes described in the above-mentioned embodiments that are obvious from description of the present specification or at which those skilled in the art can appropriately arrive should be interpreted to be provided by the present disclosure.

What is claimed is:

1. A display device comprising:

a first liquid crystal panel;

a second liquid crystal panel arranged on one surface side of the first liquid crystal panel so as to face the first liquid crystal panel;

a light source configured to emit light from the other surface side of the first liquid crystal panel; and a controller configured to control the first liquid crystal panel and the second liquid crystal panel based on an image signal corresponding to a resolution of the second liquid crystal panel, wherein the first liquid crystal panel includes a plurality of dimming pixels, the second liquid crystal panel includes a plurality of pixels, more than one of the pixels is arranged within a region of each of the dimming pixels, the controller performs blurring processing and determination of dimming gradation values as processing related to operation of the second liquid crystal panel, in the blurring processing, based on gradation values indicated by a pixel signal contained in the image signal, lower gradation values are set for second pixels farther from a first pixel that is included in the pixels and given the pixel signal, the second pixels being included in the pixels and arranged within a predetermined region around the first pixel, each of the dimming gradation values corresponds to a highest gradation value set after the blurring processing among gradation values set for the more than one pixel arranged within the region of each of the dimming pixels, and a degree of light transmission through the dimming pixel is controlled in accordance with the dimming gradation value.

2. The display device according to claim 1, wherein the first liquid crystal panel is a monochrome liquid crystal panel, the second liquid crystal panel is a color liquid crystal panel in which each of the pixels includes a first sub pixels, a second sub pixel, and a third sub pixel, the first sub pixel is provided so as to be able to transmit red light, the second sub pixel is provided so as to be able to transmit green light, and the third sub pixel is provided so as to be able to transmit blue light.

3. The display device according to claim 2, wherein the controller determines each of the dimming gradation values by using reference data of a correspondence relation between the highest gradation value as an input value and the dimming gradation value as an output value, and wherein the reference data when a gradation value set for the first sub pixel is adopted as the highest gradation value after the blurring processing, the reference data when a gradation value set for the second sub pixel is adopted as the highest gradation value after the blurring processing, the reference data when a gradation value set for the third sub pixel is adopted as the highest gradation value after the blurring processing, and the reference data when a lowest gradation value among the gradation value set for the first sub pixel, the gradation value set for the second sub pixel, and the gradation value set for the third sub pixel is adopted as the highest gradation value after the blurring processing are different from one another.

4. The display device according to claim 2, wherein the image signal is input to the second liquid crystal panel, the controller determines each of the dimming gradation values by using reference data of a correspondence relation in which the highest gradation value is an input value and the dimming gradation value is an output value, second reference data differing from first reference data is used in at least one of a first case, a second case, and a third case, the first reference data being used when a lowest gradation value among a gradation value set for the first sub pixel, a gradation value set for the second sub pixel, and a gradation value set for the third sub pixel is adopted as the highest gradation value after the blurring processing, the first case is when the gradation value set for the first sub pixel is adopted as the highest gradation value after the blurring processing, the second case is when the gradation value set for the second sub pixel is adopted as the highest gradation value after the blurring processing, the third case is when the gradation value set for the third sub pixel is adopted as the highest gradation value after the blurring processing, the second reference data includes partial data establishing a correspondence relation between the highest gradation value and the dimming gradation value, the dimming gradation value being determined to be lower in the partial data than in the first reference data, when a gradation value equal to or lower than the highest gradation value contained in the partial data is given to the pixel by the pixel signal, the controller performs first adjustment of further increasing the gradation value of the pixel signal, when the second reference data is used in the first case, the gradation value of the first sub pixel is a target of the first adjustment, when the second reference data is used in the second case, the gradation value of the second sub pixel is the target of the first adjustment, and when the second reference data is used in the third case, the gradation value of the third sub pixel is the target of the first adjustment.

5. The display device according to claim 4, wherein the controller performs second adjustment of canceling the first adjustment when the first reference data is used.

6. The display device according to claim 1, wherein the image signal is input to the second liquid crystal panel.

* * * * *